US008919109B2

(12) United States Patent
Takahashi et al.

(10) Patent No.: US 8,919,109 B2
(45) Date of Patent: Dec. 30, 2014

(54) HYDRAULIC DRIVE SYSTEM FOR CONSTRUCTION MACHINE HAVING EXHAUST GAS PURIFICATION DEVICE

(75) Inventors: Kiwamu Takahashi, Koka (JP); Yasutaka Tsuruga, Moriyama (JP); Hajime Yoshida, Omihachiman (JP); Yoshifumi Takebayashi, Koka (JP); Kazushige Mori, Koka (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 40 days.

(21) Appl. No.: 13/880,452

(22) PCT Filed: Oct. 28, 2011

(86) PCT No.: PCT/JP2011/074966

§ 371 (c)(1),
(2), (4) Date: Apr. 19, 2013

(87) PCT Pub. No.: WO2012/060298

PCT Pub. Date: May 10, 2012

(65) Prior Publication Data

US 2013/0227936 A1 Sep. 5, 2013

(30) Foreign Application Priority Data

Nov. 5, 2010 (JP) ..... 2010-248797

(51) Int. Cl.

| | |
|---|---|
| ***F01N 3/00*** | (2006.01) |
| ***F01N 9/00*** | (2006.01) |
| ***F15B 11/16*** | (2006.01) |
| ***E02F 9/22*** | (2006.01) |
| ***F02D 29/04*** | (2006.01) |
| *F01N 3/023* | (2006.01) |

(52) U.S. Cl.

CPC ..... *F01N 9/002* (2013.01); *F01N 2590/08* (2013.01); *F15B 2211/6057* (2013.01); *F15B 2211/633* (2013.01); *F15B 2211/665* (2013.01); *F15B 2211/6658* (2013.01); *F15B 2211/653* (2013.01); *F15B 2211/6652* (2013.01); *F15B 11/165* (2013.01); *E02F 9/2296* (2013.01); *F15B 2211/20553* (2013.01); *E02F 9/2285* (2013.01); *E02F 9/2235* (2013.01); *F01N 3/023* (2013.01); *F02D 29/04* (2013.01); *F15B 2211/20523* (2013.01); *F15B 2211/6058* (2013.01)

USPC ..... 60/295; 60/280; 60/286; 60/297; 60/311

(58) Field of Classification Search

USPC ..... 60/280, 286, 295, 297, 299, 311
See application file for complete search history.

(56) References Cited

U.S. PATENT DOCUMENTS

| | | | | |
|---|---|---|---|---|
| 8,161,736 | B2 * | 4/2012 | Tsukada et al. | 60/295 |
| 8,365,518 | B2 * | 2/2013 | Ezawa et al. | 60/297 |

(Continued)

FOREIGN PATENT DOCUMENTS

| | | | |
|---|---|---|---|
| JP | 07-166840 | A | 6/1995 |
| JP | 3073380 | A | 6/2000 |

(Continued)

OTHER PUBLICATIONS

International Preliminary Report on Patentability received in International Application No. PCT/JP2011/074966 dated May 16, 2013.

*Primary Examiner* — Binh Q Tran
(74) *Attorney, Agent, or Firm* — Mattingly & Malur, PC

(57) ABSTRACT

A hydraulic drive system executing load sensing control is capable of efficiently combusting and removing filter deposits inside an exhaust gas purification device by pump output power increasing control when there is no actuator operation, eliminating interference between the actuator operation and the pump output power increasing control. A first solenoid selector valve selects between tank pressure and delivery pressure of a pilot pump. A second solenoid selector valve is arranged in a line leading the output pressure of a differential pressure reducing valve to an LS control valve for selecting between enabling and disabling of the load sensing control. When the exhaust gas purification device needs regeneration, a controller executes switching to make the first solenoid selector valve output the delivery pressure of the pilot pump as dummy load pressure and to make the second solenoid selector valve disable the load sensing control.

11 Claims, 8 Drawing Sheets

(56) References Cited

U.S. PATENT DOCUMENTS

| | | | | |
|---|---|---|---|---|
| 8,516,805 | B2 * | 8/2013 | Hagiwara et al. | 60/295 |
| 8,601,799 | B2 * | 12/2013 | Asakage et al. | 60/295 |
| 8,613,192 | B2 * | 12/2013 | Masuda et al. | 60/295 |
| 2010/0089035 | A1 | 4/2010 | Kamiya et al. | |
| 2010/0122522 | A1 | 5/2010 | Tsukada et al. | |

FOREIGN PATENT DOCUMENTS

| | | | |
|---|---|---|---|
| JP | 2001-193705 | A | 7/2001 |
| JP | 2009-079500 | A | 4/2009 |
| JP | 2010-059620 | A | 3/2010 |
| JP | 2010-121466 | A | 6/2010 |

* cited by examiner

HYDRAULIC DRIVE SYSTEM FOR CONSTRUCTION MACHINE HAVING EXHAUST GAS PURIFICATION DEVICE

TECHNICAL FIELD

The present invention relates to a hydraulic drive system which is used for a construction machine (e.g., hydraulic shovel) and executes load sensing control so that the delivery pressure of the hydraulic pump becomes higher than the maximum load pressure of a plurality of actuators by a target differential pressure. In particular, the present invention relates to a hydraulic drive system for a construction machine having an exhaust gas purification device for purifying/removing particulate matter contained in the exhaust gas from the engine.

BACKGROUND ART

A hydraulic drive system which executes a load sensing control so that the delivery pressure of the hydraulic pump becomes higher than the maximum load pressure of the actuators by a target differential pressure is called a load sensing system, which is described in Patent Literature 1, for example.

The hydraulic drive system described in the Patent Literature 1 comprises an engine, a hydraulic pump of a variable displacement type which is driven by the engine, a plurality of actuators which are driven by hydraulic fluid delivered from the hydraulic pump, a plurality of flow rate/direction control valves which control flow rates of the hydraulic fluid supplied from the hydraulic pump to the actuators, a detecting circuit which detects the maximum load pressure of the actuators, control means which executes the load sensing control so that the delivery pressure of the hydraulic pump becomes higher than the maximum load pressure of the actuators by target differential pressure, and an unload valve which is arranged in a pipeline connecting the hydraulic pump to the flow rate/direction control valves and restricts the increase in the delivery pressure of the hydraulic pump by shifting to an open state and returning the hydraulic fluid from the hydraulic pump to a tank when the delivery pressure of the hydraulic pump exceeds the sum total of the maximum load pressure and preset pressure.

A load sensing system equipped with an exhaust gas purification device has been described in Patent Literature 2. In this system, the exhaust gas purification device attached to the exhaust pipe is equipped with an exhaust resistance sensor. When the measurement by the exhaust resistance sensor has reached a prescribed level or higher, a control device of the load sensing system outputs signals to control the unload valve and a regulator of the main pump (hydraulic pump), by which the delivery flow rate and the delivery pressure of the hydraulic pump are raised at the same time and a certain hydraulic load is put on the engine. Due to the increase in the engine load, the output power of the engine increases, the exhaust gas temperature rises, the oxidation catalyst inside the exhaust gas purification device is activated, the deposits on the filter (filter deposits) are combusted, and the filter is regenerated.

PRIOR ART LITERATURE

Patent Literature

Patent Literature 1: JP,A 2001-193705
Patent Literature 2: Japanese Patent No. 3073380

SUMMARY OF THE INVENTION

Problem to be Solved by the Invention

A construction machine (e.g., hydraulic shovel) is generally equipped with a diesel engine as its driving source. Regulations regarding the amount of the particulate matter (hereinafter referred to as "PM") emitted from the diesel engine are being tightened year after year along with those regarding NOx, CO, HC, etc. To abide by such regulations, efforts to reduce the amount of PM emitted to the outside are being made commonly by equipping the engine with an exhaust gas purification device and capturing and collecting the PM with a filter (called "diesel particulate filter (DPF)") inside the engine exhaust gas purification device. In such an exhaust gas purification device, the filter gradually gets clogged as the amount of the PM captured and accumulated on the filter increases. The clogging of the filter causes an increase in the exhaust pressure of the engine and deterioration in the fuel efficiency. Therefore, it is necessary to remove the clogging of the filter (i.e., regenerate the filter) by properly combusting the PM accumulated on the filter.

An oxidation catalyst is generally used for the filter regeneration. The oxidation catalyst may be placed upstream of the filter, directly held by the filter, or placed at both positions. In either case, the temperature of the exhaust gas has to be higher than the activation temperature of the oxidation catalyst in order to realize the activation of the oxidation catalyst. Thus, it is necessary to forcibly raise the exhaust gas temperature above the activation temperature of the oxidation catalyst.

In the hydraulic drive system described in the Patent Literature 1, the main pump (hydraulic pump) of the variable displacement type carries out the load sensing control. Therefore, the tilting angle (displacement) and the delivery flow rate of the main pump are both at the minimum levels when all the control levers are at the neutral positions, for example. Meanwhile, the delivery pressure of the main pump is controlled by the unload valve. When all the control levers are at the neutral positions, the delivery pressure of the main pump takes on minimum pressure which is substantially equal to preset pressure of the unload valve. Consequently, the absorption torque of the main pump also takes on the minimum value when all the control levers are at the neutral positions.

In cases where the engine of a hydraulic drive system executing such load sensing control is equipped with the exhaust gas purification device, the load on the engine and the temperature of the exhaust gas from the engine are necessitated to be low when all the control levers are at the neutral positions.

In the hydraulic drive system described in the Patent Literature 2, the need of regenerating the filter of the exhaust gas purification device is detected by the exhaust resistance sensor and control for simultaneously increasing the delivery flow rate and the delivery pressure of the main pump (hereinafter referred to as "pump output power increasing control") is carried out. By the pump output power increasing control, a certain hydraulic load is put on the engine, the output power of the engine is increased, the exhaust gas temperature is raised, the oxidation catalyst is activated, and the filter deposits are combusted. Therefore, the filter regeneration can be conducted by avoiding the drop in the absorption torque of the main pump even when all the control levers are at the neutral positions.

In the technology of the Patent Literature 2, however, the operation (manipulation) of an actuator (hereinafter referred to as an "actuator operation") and the pump output power increasing control can affect each other when the actuator operation and the pump output power increasing control are performed at the same time (executing the pump output power increasing control while operating an actuator by manipulating a control lever, or manipulating a control lever and thereby operating an actuator during the pump output power increasing control). In such cases, there is a possibility of deterioration in the operability of the actuators or occurrence of trouble in the pump output power increasing control.

Specifically, in the Patent Literature 2, in conditions in which the exhaust gas purification device needs the regeneration, a target flow rate Q2 is achieved by directly controlling the regulator of the main pump by the signal from the control device and a target pressure P2 is achieved by directly controlling the unload valve by the signal from the control device. By the control, the target pressure P2 and the target flow rate Q2 are achieved when all the control levers are at the neutral positions and there is no actuator operation. Thus, the absorption torque of the main pump can be adjusted to a target value that is necessary for the pump output power increasing control.

However, if an actuator operation of a low load and a high flow rate (e.g., arm crowd operation) is performed during the pump output power increasing control, for example, the hydraulic fluid delivered from the main pump flows into the arm cylinder. In this case, the arm cylinder cannot reach its target speed when its demanded flow rate is higher than the target flow rate Q2 of the main pump achieved by the regulator control implemented by the pump output power increasing control. Further, the delivery pressure of the main pump also drops and cannot reach the target pressure P2. Consequently, the absorption torque of the main pump also drops from the optimum value.

Further, if an actuator operation of a high load and a low flow rate (e.g., bucket dump operation) is performed during the pump output power increasing control, for example, both the signal from the control device and the original load pressure of the actuator act on the unload valve. In this case, the delivery pressure of the main pump, which is controlled by the unload valve, becomes higher than the target pressure P2. Consequently, the absorption torque of the main pump also increases from the optimum value.

For the above reasons, the Patent Literature 2 recommends that the pump output power increasing control should be conducted only when the control levers are at the neutral positions.

Furthermore, the unload valve is a component to which the load pressure of the actuators and the delivery pressure of the main pump (relatively high) act. In order to electrically control the unload valve by a signal outputted from the control device, the electric control unit is necessitated to be highly expensive.

It is therefore the primary object of the present invention to provide a construction machine's hydraulic drive system that executes the load sensing control and that is capable of efficiently combusting and removing the filter deposits inside the exhaust gas purification device by the pump output power increasing control when there is no actuator operation, eliminating the interaction (interference) between the actuator operation and the pump output power increasing control (deterioration in the operability of the actuators or occurrence of trouble in the pump output power increasing control) even when the actuator operation and the pump output power increasing control are performed at the same time, and achieving these effects with ease and at a low cost.

Means for Solving the Problem (1) To achieve the above object, in a hydraulic drive system for a construction machine comprising: an engine; a hydraulic pump of a variable displacement type, which is driven by the engine; a plurality of actuators which are driven by hydraulic fluid delivered from the hydraulic pump; a plurality of flow rate/direction control valves which control flow rates of the hydraulic fluid supplied from the hydraulic pump to the actuators; a maximum load pressure detecting circuit which detects maximum load pressure of the actuators; a pump control device including a torque control unit which conducts constant absorption torque control for controlling absorption torque of the hydraulic pump not to exceed preset maximum torque by reducing displacement of the hydraulic pump with the increase in delivery pressure of the hydraulic pump, and a load sensing control unit which controls the delivery pressure of the hydraulic pump to be higher than the maximum load pressure of the actuators by target differential pressure; and an unload valve which is arranged in a line connecting the hydraulic pump to the plurality of flow rate/direction control valves and restricts the increase in the delivery pressure of the hydraulic pump by shifting to an open state and returning the delivered hydraulic fluid from the hydraulic pump to a tank when the delivery pressure of the hydraulic pump exceeds the sum total of the maximum load pressure and preset pressure, a hydraulic drive system in accordance with the present invention comprises: a first selector valve which selects between predetermined pressure and tank pressure, outputs the selected pressure, and supplies the output pressure to the maximum load pressure detecting circuit as dummy load pressure; a second selector valve which selects between enabling and disabling of load sensing control implemented by the load sensing control unit of the pump control device; an exhaust gas purification device which purifies exhaust gas from the engine; and a control device which actuates the first and second selector valves so that the first selector valve outputs the tank pressure as the dummy load pressure and the second selector valve enables the load sensing control implemented by the pump control device when the exhaust gas purification device does not need regeneration and so that the first selector valve outputs the predetermined pressure as the dummy load pressure and the second selector valve disables the load sensing control implemented by the pump control device when the exhaust gas purification device needs the regeneration.

The present invention configured as above operates as follows:

When the regeneration of the exhaust gas purification device has become necessary due to the increase in the PM accumulation level of the filter in the exhaust gas purification device, the control device switches the first and second selector valves, the first selector valve outputs the predetermined pressure as the dummy load pressure when there is no actuator operation, and the second selector valve disables the load sensing control.

Thanks to the first selector valve outputting the predetermined pressure as the dummy load pressure, the maximum load pressure detecting circuit selects the higher one of the dummy load pressure (predetermined pressure) and the actual highest load pressure of the actuators as the maximum load pressure. Thus, by the function of the unload valve, the delivery pressure of the hydraulic pump is kept at a level as the sum total of the higher pressure (selected from the dummy load pressure (predetermined pressure) and the actual highest load pressure of the actuators), the preset pressure of the unload valve and pressure determined by the override characteristic of the unload valve. Due to the disabling of the load sensing control, only the torque control unit functions in the pump control device and the displacement of the hydraulic pump increases within the maximum torque of the constant absorption torque control conducted by the torque control unit. Therefore, by presetting the predetermined pressure (dummy load pressure) at an appropriate value, the absorption torque of the hydraulic pump desirably increases to the maximum torque of the constant absorption torque control conducted by the torque control unit. In short, pump output power increasing control (pump absorption torque increasing control) employing the constant absorption torque control by the torque control unit is conducted.

When the absorption torque of the hydraulic pump increases as above, the load on the engine increases accordingly and the exhaust temperature rises. Since the oxidation catalyst installed in the exhaust gas purification device is activated by the high temperature, unburned fuel supplied to the exhaust gas is combusted due to the activated oxidation catalyst, the temperature of the exhaust gas is increased, and the PM accumulated on the filter is combusted and removed by the high-temperature exhaust gas.

Even when an actuator operation of a low load and a high flow rate is performed during the pump output power increasing control and hydraulic fluid delivered from the hydraulic pump flows into the actuator, the pump control device continues the control for increasing the displacement of the hydraulic pump within the maximum torque of the constant absorption torque control conducted by the torque control unit since the load sensing control has been disabled. Consequently, a necessary amount (flow rate) of hydraulic fluid can be supplied to the actuator and the actuator operation can be performed without being affected by the pump output power increasing control.

Further, even in the case where the load pressure of the actuator(s) is lower than the dummy load pressure (predetermined pressure), the dummy load pressure (predetermined pressure) is selected as the maximum load pressure and the delivery pressure of the hydraulic pump is kept at the same level as that before the actuator operation thanks to the function of the unload valve. Thus, the delivery pressure of the hydraulic pump is prevented from being affected by the actuator operation and dropping. Consequently, the pump output power increasing control equivalent to that before the actuator operation can be carried out.

Furthermore, when an actuator operation of a high load and a low flow rate is performed during the pump output power increasing control, the load pressure of the actuator is selected as the maximum load pressure and the delivery pressure of the hydraulic pump increases depending on the load pressure of the actuator thanks to the function of the unload valve. In this case, the absorption torque of the hydraulic pump is controlled not to exceed the maximum torque by the constant absorption torque control conducted by the torque control unit. Consequently, the pump output power increasing control equivalent to that before the actuator operation can be carried out without being affected by the actuator operation. Meanwhile, the actuator operation can be performed without being affected by the pump output power increasing control since the delivery pressure of the hydraulic pump increases according to the load pressure.

As above, the interaction (interference) between the actuator operation and the pump output power increasing control is eliminated even when they are conducted at the same time. Consequently, the deterioration in the operability of the actuators (caused by the pump output power torque increasing control) and the occurrence of trouble in the pump output power increasing control (caused by the actuator operation) can be prevented.

Further, the above effects can be achieved with ease and at a low cost since the first and second selector valves are relatively low-priced selector valves.

(2) Preferably, in the above configuration (1), the hydraulic drive system further comprises: a pilot pump which is driven by the engine; a pilot pressure supply line which is connected with the pilot pump and supplies hydraulic fluid for controlling the flow rate/direction control valves; and an engine revolution speed detecting valve which includes a throttling portion arranged in the pilot pressure supply line and generates a hydraulic signal dependent on the engine revolution speed by using pressure loss (pressure drop) at the throttling portion. The load sensing control unit of the pump control device is configured to set the hydraulic signal generated by the engine revolution speed detecting valve as the target differential pressure of the load sensing control. The first selector valve outputs delivery pressure of the pilot pump as pressure upstream of the engine revolution speed detecting valve as the predetermined pressure.

With the above configuration, the predetermined pressure as the dummy load pressure can be generated by use of already-existing pressure (i.e., the pressure upstream of the engine revolution speed detecting valve).

(3) Preferably, in the above configuration (1) or (2), the hydraulic drive system further comprises a differential pressure reducing valve which outputs differential pressure between the delivery pressure of the hydraulic pump and the maximum load pressure to the pump control device as absolute pressure. The second selector valve is arranged in a line leading the output pressure of the differential pressure reducing valve to the load sensing control unit of the pump control device. The second selector valve is switched so as to output the output pressure of the differential pressure reducing valve when the exhaust gas purification device does not need the regeneration and to output the tank pressure when the exhaust gas purification device needs the regeneration.

With the above configuration, the switching of the enabling/disabling of the load sensing control can be implemented by the simple configuration in which the second selector valve is just inserted in the line leading the output pressure of the differential pressure reducing valve to the load sensing control unit of the pump control device.

(4) Preferably, in any one of the above configurations (1) to (3), the hydraulic drive system further comprises a pressure detecting device for detecting exhaust resistance of the exhaust gas purification device. The control device executes control to simultaneously switch the first and second selector valves based on the result of the detection by the pressure detecting device.

With the above configuration, whether the regeneration of the exhaust gas purification device is necessary or not can be detected by using the pressure detecting device and the first and second selector valves can be switched according to the detection.

(5) Preferably, in any one of the above configurations (1) to (4), the torque control unit of the pump control device is preset to exhibit a characteristic regarding relationship between the delivery pressure and the displacement of the hydraulic pump. The characteristic is made up of a constant maximum displacement characteristic and a constant maximum absorption torque characteristic. The torque control unit is configured to control the displacement of the hydraulic pump so as to keep maximum displacement of the hydraulic pump at a constant level even with the increase in the delivery pressure of the hydraulic pump when the delivery pressure of the hydraulic pump is not higher than a first value (as pressure at a transition point from the constant maximum displacement characteristic to the constant maximum absorption torque characteristic), and so as to decrease the maximum displacement of the hydraulic pump according to the constant maximum absorption torque characteristic when the delivery pressure of the hydraulic pump increases across the first value. The predetermined pressure is preset so that the sum total of the predetermined pressure, the preset pressure of the unload valve and override characteristic pressure of the unload valve is not less than pressure around the transition point from the constant maximum displacement characteristic to the constant maximum absorption torque characteristic.

With the above configuration, the pump output power increasing control can be carried out with the maximum torque employing the constant absorption torque control conducted by the torque control unit, irrespective of whether the dummy load pressure is selected as the maximum load pressure or the actual load pressure is selected as the maximum load pressure.

Effects of the Invention

As described above, a hydraulic drive system executing the load sensing control is enabled to efficiently combust and remove the filter deposits inside the exhaust gas purification device by the pump output power increasing control when there is no actuator operation, and the interaction (interference) between the actuator operation and the pump output power increasing control (deterioration in the operability of the actuators or occurrence of trouble in the pump output power increasing control) is eliminated even when the actuator operation and the pump output power increasing control are performed at the same time. Further, these effects can be achieved with ease and at a low cost.

MODE FOR CARRYING OUT THE INVENTION

Figure 1:
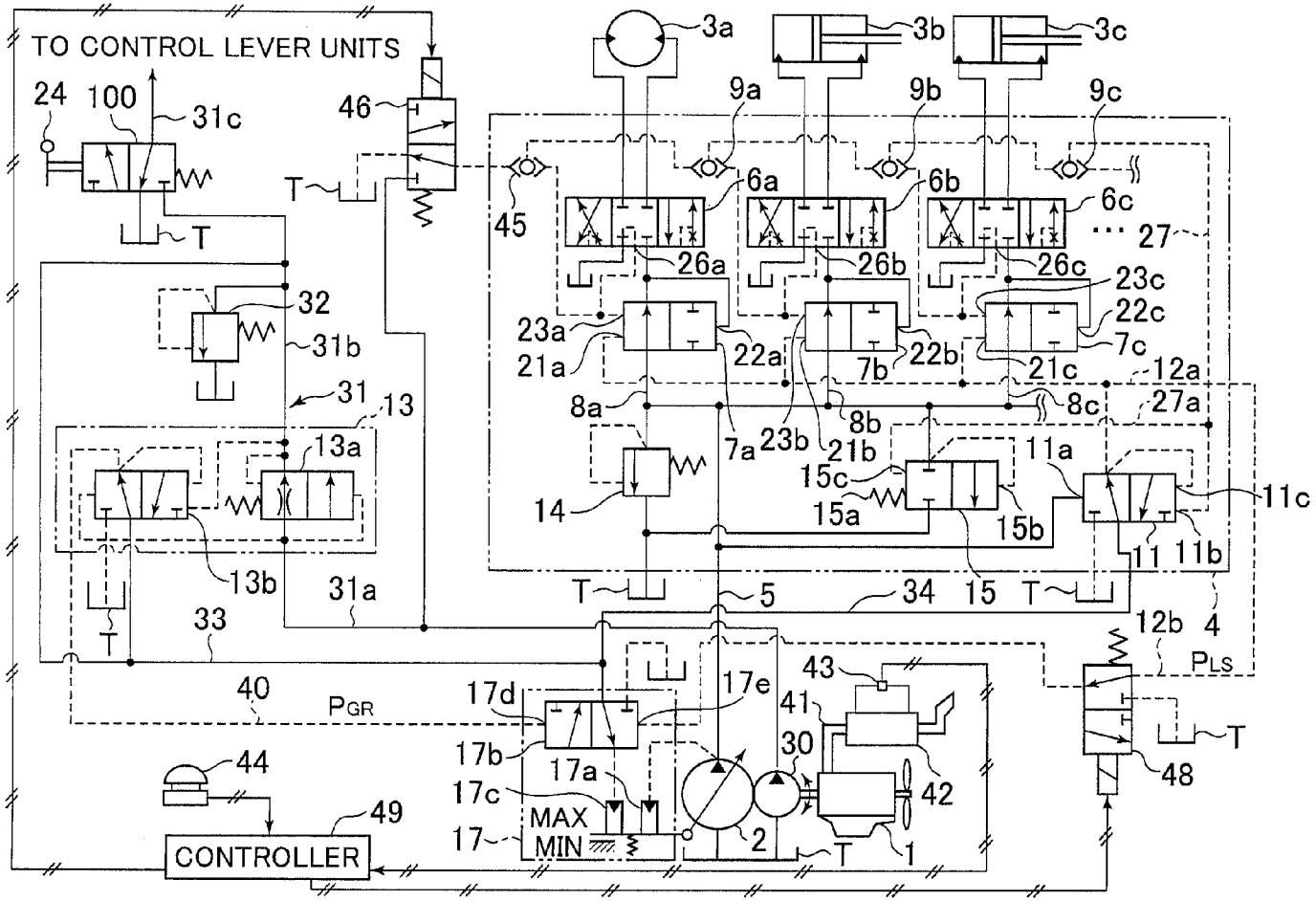
FIG. 1 is a schematic diagram showing the configuration of a hydraulic drive system in accordance with a first embodiment of the present invention.

Referring now to the drawings, a description will be given in detail of preferred embodiments in accordance with the present invention.

First Embodiment

Configuration

FIG. 1 is a schematic diagram showing the configuration of a hydraulic drive system in accordance with a first embodiment of the present invention. In this embodiment, the present invention is applied to a hydraulic drive system for a hydraulic shovel of a front swing type.

Referring to FIG. 1, the hydraulic drive system in accordance with this embodiment comprises an engine 1, a hydraulic pump 2, a pilot pump 30, a plurality of actuators 3*a*, 3*b*, 3*c* . . . , a plurality of flow rate/direction control valves 6*a*, 6*b*, 6*c* . . . , pressure compensating valves 7*a*, 7*b*, 7*c* . . . , shuttle valves 9*a*, 9*b*, 9*c* . . . , a differential pressure reducing valve 11, a main relief valve 14, an unload valve 15, a pump control device 17, a pilot pressure supply line 31, an engine revolution speed detecting valve 13, a pilot relief valve 32, a gate lock valve 100, and control lever units 122 and 123.

The hydraulic pump 2 is a pump of a variable displacement type that functions as the main pump driven by the engine 1 (hereinafter referred to as a "main pump 2"). The pilot pump 30 is a pump of a fixed displacement type that is driven by the engine. The actuators 3*a*, 3*b*, 3*c* . . . are driven by hydraulic fluid delivered from the main pump 2. The flow rate/direction control valves 6*a*, 6*b*, 6*c* . . . are valves of a closed center type that are connected respectively to lines 8*a*, 8*b*, 8*c* . . . corresponding to the actuators 3*a*, 3*b*, 3*c* . . . ) connected to a hydraulic fluid supply line 5 from the main pump 2. The flow rate/direction control valves 6*a*, 6*b*, 6*c* . . . control the flow rates and the directions of the hydraulic fluid supplied from the main pump 2 to the actuators 3*a*, 3*b*, 3*c* . . . . The pressure compensating valves 7*a*, 7*b*, 7*c* . . . are connected to the lines 8*a*, 8*b*, 8*c* . . . at positions upstream of the flow rate/direction control valves 6*a*, 6*b*, 6*c* . . . , respectively. The pressure compensating valves 7*a*, 7*b*, 7*c* . . . control differential pressures across meter-in throttling portions of the flow rate/direction control valves 6*a*, 6*b*, 6*c* . . . , respectively. The shuttle valves 9*a*, 9*b*, 9*c* . . . select the maximum pressure from the load pressures of the actuators 3*a*, 3*b*, 3*c* . . . and output the selected maximum load pressure. The differential pressure reducing valve 11 outputs differential pressure between the delivery pressure of the main pump 2 and the maximum load pressure to lines 12*a* and 12*b* as absolute pressure. The main relief valve 14 is connected to the hydraulic fluid supply line 5 from the main pump 2 and restricts the pressure in the supply line 5 (maximum delivery pressure of the main pump 2—maximum circuit pressure) so that the pressure does not exceed preset pressure. The unload valve 15 is connected to the hydraulic fluid supply line 5 from the main pump 2 and restricts the increase in the pressure in the supply line with respect to the maximum load pressure, by shifting to an open state and returning the hydraulic fluid in the supply line 5 to a tank T when the pressure in the supply line 5 exceeds the sum total of the maximum load pressure and cracking pressure (preset pressure) Pun set by a spring 15*a*. The pump control device 17 controls the tilting angle (displacement, displacement volume) of the main pump 2. The pilot pressure supply line 31 is connected to the pilot pump 30 and supplies hydraulic fluid for controlling the flow rate/direction control valves 6*a*, 6*b*, 6*c* . . . . The engine revolution speed detecting valve 13 is arranged in the pilot pressure supply line 31 and outputs a pressure signal which is dependent on the engine revolution speed (revolution speed of the engine 1) as absolute pressure Pgr, based on the delivery flow rate of the pilot pump 30 which is proportional to the engine revolution speed. The pilot relief valve 32 is connected to a pilot line 31*b* (part of the pilot pressure supply line 31 downstream of the engine revolution speed detecting valve 13) and maintains the pressure in the pilot line 31*b* at a constant level. The gate lock valve 100 is operated by a gate lock lever 24 and functions as a safety valve which selectively connects a pilot line 31*c* (part of the pilot pressure supply line 31 still downstream of the pilot line 31*b*) with the pilot line 31*b* or the tank T. The control lever units 122 and 123 (see FIG. 4) are connected to the pilot line 31*c* and generate command pilot pressures (command signals) for operating the flow rate/direction control valves 6*a*, 6*b*, 6*c* . . . and activating the corresponding actuators 3*a*, 3*b*, 3*c* . . . .

The actuators 3*a*, 3*b* and 3*c* are, for example, a swing motor, a boom cylinder and an arm cylinder of the hydraulic shovel. The flow rate/direction control valves 6*a*, 6*b* and 6*c* are, for example, flow rate/direction control valves for the swinging, the boom and the arm, respectively. For convenience of illustration, the other actuators (bucket cylinder, boom swing cylinder, track motors, etc.) and flow rate/direction control valves related to these actuators are unshown in the figures.

The pressure compensating valves 7*a*, 7*b*, 7*c* . . . include pressure receiving parts 21*a*, 21*b*, 21*c* . . . for action in the opening direction (to each of which the output pressure of the differential pressure reducing valve 11 is lead via the line 12*a* as target compensation differential pressure of the pressure compensating valve 7*a*, 7*b*, 7*c* . . . ) and pressure receiving parts 22*a*, 23*a*, 22*b*, 23*b*, 22*c*, 23*c* . . . for detecting the differential pressures across the meter-in throttling portions of the flow rate/direction control valves 6*a*, 6*b*, 6*c* . . . . Each pressure compensating valve 7*a*, 7*b*, 7*c* . . . executes control so that the differential pressure across the meter-in throttling portion of the flow rate/direction control valve 6*a*, 6*b*, 6*c* . . . equals the output pressure of the differential pressure reducing valve 11 (differential pressure between the delivery pressure of the main pump 2 and the maximum load pressure of the actuators 3*a*, 3*b*, 3*c* . . . ). Thus, the target compensation differential pressure of each pressure compensating valve 7*a*, 7*b*, 7*c* . . . is set to be equal to the differential pressure between the delivery pressure of the main pump 2 and the maximum load pressure of the actuators 3*a*, 3*b*, 3*c* . . . .

Each flow rate/direction control valve 6*a*, 6*b*, 6*c* . . . has a load port 26*a*, 26*b*, 26*c* . . . . The load port 26*a*, 26*b*, 26*c* . . . is connected with the tank T and outputs the tank pressure as the load pressure when the flow rate/direction control valve 6*a*, 6*b*, 6*c* . . . is at its neutral position. When the flow rate/direction control valve 6*a*, 6*b*, 6*c* . . . is switched from the neutral position to an operating position (right or left in the figure), the load port 26*a*, 26*b*, 26*c* . . . is connected with the corresponding actuator 3*a*, 3*b*, 3*c* . . . and outputs the load pressure of the actuator 3*a*, 3*b*, 3*c* . . . .

The shuttle valves 9*a*, 9*b*, 9*c* . . . , which are connected in tournament formation, constitute a maximum load pressure detecting circuit together with the load ports 26*a*, 26*b*, 26*c* . . . of the flow rate/direction control valves 6*a*, 6*b*, 6*c* . . . . Specifically, the shuttle valve 9*a* selects the higher one from the pressure at the load port 26*a* of the flow rate/direction control valve 6*a* supplied via a shuttle valve 45 (explained later) and the pressure at the load port 26*b* of the flow rate/direction control valve 6*b* and outputs the selected higher pressure. The shuttle valve 9*b* selects the higher one from the output pressure of the shuttle valve 9*a* and the pressure at the load port 26*c* of the flow rate/direction control valve 6*c* and outputs the selected higher pressure. The shuttle valve 9*c* selects the higher one from the output pressure of the shuttle valve 9*b* and output pressure of another equivalent shuttle valve (unshown) and outputs the selected higher pressure. The shuttle valve 9*c* is the final-stage shuttle valve, whose output pressure is lead to the differential pressure reducing valve 11 and the unload valve 15 via signal lines 27 and 27*a* as the maximum load pressure.

The differential pressure reducing valve 11 is a valve that is supplied with the pressure in the pilot line 31*b* via lines 33 and 34 and generates the differential pressure between the delivery pressure of the main pump 2 and the maximum load pressure (as absolute pressure) by using the pressure in the pilot line 31*b* as the source pressure. The differential pressure reducing valve 11 has a pressure receiving part 11*a* to which the delivery pressure of the main pump 2 is lead, a pressure receiving part 11*b* to which the maximum load pressure is lead, and a pressure receiving part 11*c* to which its own output pressure is lead.

The unload valve 15 includes the aforementioned spring 15*a* (for action in the closing direction) which sets the cracking pressure Pun of the unload valve 15, a pressure receiving part 15*b* (for action in the opening direction) to which the pressure in the supply line 5 (the delivery pressure of the main pump 2) is lead, and a pressure receiving part 15*c* (for action in the closing direction) to which the maximum load pressure is lead via the signal line 27*a*. When the pressure in the supply line 5 exceeds the sum total of the maximum load pressure and the preset pressure Pun of the spring 15*a*, the unload valve 15 restricts the increase in the pressure in the supply line 5 by shifting to the open state and returning the hydraulic fluid in the supply line 5 to the tank T. The preset pressure Pun of the spring 15*a* of the unload valve 15 is generally set substantially equal to target differential pressure (explained later) of the load sensing control (which is determined by the output pressure of a differential pressure reducing valve 13*b* of the engine revolution speed detecting valve 13 when the engine 1 is at the rated maximum revolution speed) or slightly higher than the target differential pressure. In this embodiment, the preset pressure Pun of the spring 15*a* is set equal to the target differential pressure of the load sensing control.

The flow rate/direction control valves 6*a*, 6*b*, 6*c* . . . , the pressure compensating valves 7*a*, 7*b*, 7*c* . . . , the shuttle valves 9*a*, 9*b*, 9*c* . . . , the shuttle valve 45 (explained later), the differential pressure reducing valve 11, the main relief valve 14 and the unload valve 15 are arranged in a control valve 4.

The engine revolution speed detecting valve 13 is made up of a variable throttle valve 13*a* having a variable throttling characteristic dependent on the delivery flow rate of the pilot pump 30 and the aforementioned differential pressure reducing valve 13*b* outputting the differential pressure across the variable throttle valve 13*a* as the absolute pressure Pgr. Since the delivery flow rate of the pilot pump 30 changes depending on the engine revolution speed, the differential pressure across the variable throttle valve 13*a* also changes depending on the engine revolution speed, and consequently, the absolute pressure Pgr outputted by the differential pressure reducing valve 13*b* also changes depending on the engine revolution speed. The output pressure of the differential pressure reducing valve 13*b* (the absolute pressure as the differential pressure across the variable throttle valve 13*a*) is lead to the pump control device 17 (which controls the tilting angle (displacement, displacement volume) of the main pump 2) via a line 40 as the target differential pressure of the load sensing control. With this configuration, the so-called saturation, which is dependent on the engine revolution speed, can be mitigated and satisfactory fine-tuning operability can be achieved when the engine revolution speed is set in a low range. This feature has been elaborated on in JP-A-10-196604.

The pump control device 17 includes a torque control tilting piston 17*a* (torque control unit), an LS control valve 17*b* (load sensing control unit), and an LS control tilting piston 17*c* (load sensing control unit).

The torque control tilting piston 17*a* controls the absorption torque (input torque) of the main pump 2 to prevent the absorption torque from exceeding preset maximum torque, by reducing the tilting angle of the main pump 2 with the increase in its delivery pressure. Consequently, the absorption torque of the main pump 2 is controlled not to exceed limit torque ("TEL" shown in FIG. 2) of the engine 1, consumption of power by the main pump 2 is limited, and stoppage of the engine 1 due to an overload (engine stall) is prevented.

The LS control valve 17*b* has pressure receiving parts 17*d* and 17*e* opposing each other. The pressure receiving part 17*d* is supplied with the output pressure of the differential pressure reducing valve 13*b* of the engine revolution speed detecting valve 13 via the line 40 as the target differential pressure of the load sensing control (target LS differential pressure). The pressure receiving part 17*e* is supplied with the output pressure of the differential pressure reducing valve 11 (absolute pressure of the differential pressure between the delivery pressure of the main pump 2 and the maximum load pressure) via the line 12*b*. When the output pressure of the differential pressure reducing valve 11 exceeds that of the differential pressure reducing valve 13*b*, the LS control valve 17*b* reduces the tilting angle of the main pump 2 by leading the pressure in the pilot line 31*b* to the LS control tilting piston 17*c* via the line 33. When the output pressure of the differential pressure reducing valve 11 falls below that of the differential pressure reducing valve 13*b*, the LS control valve 17*b* increases the tilting angle of the main pump 2 by connecting the LS control tilting piston 17*c* with the tank T. By these operations, the LS control valve 17*b* controls the tilting angle of the main pump 2 so that the delivery pressure of the main pump 2 becomes higher than the maximum load pressure by the output pressure of the differential pressure reducing valve 13*b* (target differential pressure). Consequently, the LS control valve 17*b* and the LS control tilting piston 17*c* execute the load sensing control so that the delivery pressure Pd of the main pump 2 becomes higher than the maximum load pressure PLmax of the actuators 3*a*, 3*b*, 3*c* . . . by the target differential pressure.

Figure 2:
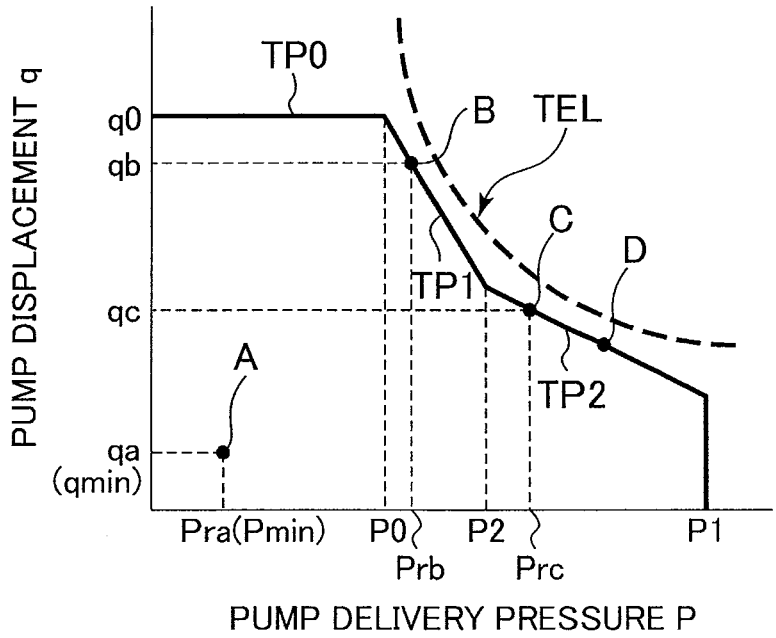
FIG. 2 is a graph showing a Pq (pressure—pump displacement) characteristic of a main pump implemented by a torque control tilting piston.
Figure 3:
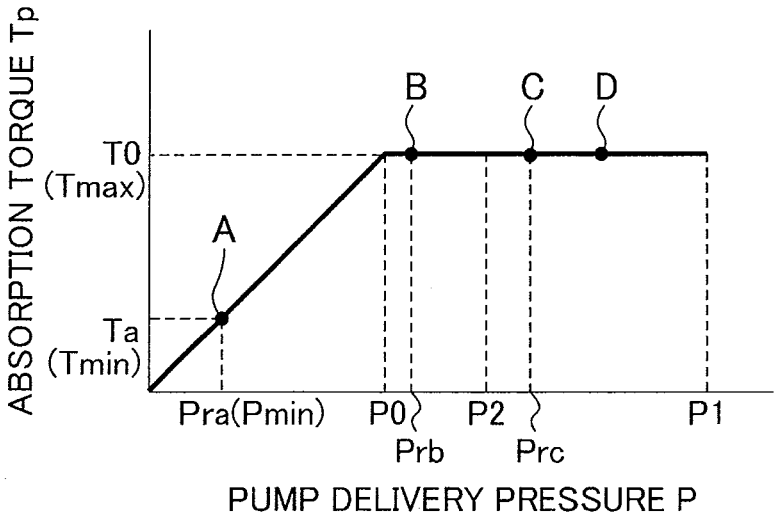
FIG. 3 is a graph showing an absorption torque characteristic of the main pump.

The details of the torque control performed by the torque control tilting piston 17*a* will be explained below referring to FIGS. 2 and 3. FIG. 2 is a graph showing a characteristic representing the relationship between the delivery pressure and the displacement (tilting angle) of the main pump 2 (hereinafter referred to as a "Pq (pressure—pump displacement) characteristic") implemented by the torque control tilting piston 17*a*. FIG. 3 is a graph showing the absorption torque characteristic of the main pump 2. The horizontal axes in FIGS. 2 and 3 represent the delivery pressure P of the main pump 2. The vertical axis in FIG. 2 represents the displacement (or tilting angle) q of the main pump 2. The vertical axis in FIG. 3 represents the absorption torque Tp of the main pump 2.

Referring to FIG. 2, the Pq characteristic of the main pump 2 is composed of a constant maximum displacement characteristic Tp0 and constant maximum absorption torque characteristics Tp1 and Tp2.

When the delivery pressure P of the main pump 2 is not higher than a first value P0 as the pressure at the turning point (transition point) where the Pq characteristic shifts from the constant maximum displacement characteristic Tp0 to the constant maximum absorption torque characteristics Tp1 and Tp2, the maximum displacement of the main pump 2 remains constant (q0) even with the increase in the delivery pressure P of the main pump 2. In this case, the maximum absorption torque of the main pump 2 (product of the pump delivery pressure and the pump displacement) increases with the increase in the delivery pressure P of the main pump 2 as shown in FIG. 3. When the delivery pressure P of the main pump 2 increases across the first value P0, the maximum displacement of the main pump 2 decreases along the characteristic line of the constant maximum absorption torque characteristics Tp1 and Tp2, whereas the absorption torque of the main pump 2 is kept at maximum torque Tmax which is determined by the characteristics Tp1 and Tp2. The characteristic line of the characteristics Tp1 and Tp2 has been set by using two springs (unshown) so as to approximate a constant absorption torque curve (hyperbolic curve), and thus the maximum torque Tmax remains substantially constant. The maximum torque Tmax has been set to be lower than the limit torque TEL of the engine 1. With these settings, when the delivery pressure P of the main pump 2 increases across the first value P0, the absorption torque (input torque) of the main pump 2 is controlled not to exceed the preset maximum torque Tmax or the limit torque TEL of the engine 1 through the reduction of the maximum displacement of the main pump 2. The control of the maximum absorption torque by use of the characteristics Tp1 and Tp2 will hereinafter be referred to as constant absorption torque control (or constant absorption power control).

Returning to FIG. 1, the hydraulic drive system in this embodiment also has the following configuration in addition to the configuration described above:

The hydraulic drive system comprises an exhaust gas purification device 42, an exhaust resistance sensor 43, a forcible regeneration switch 44, the aforementioned shuttle valve 45, a solenoid selector valve 46 (first selector valve), a solenoid selector valve 48 (second selector valve), and a controller 49 (control device). The exhaust gas purification device 42 is arranged in a line 41 constituting the exhaust system of the engine 1. The exhaust resistance sensor 43 detects exhaust resistance inside the exhaust gas purification device 42. The forcible regeneration switch 44 commands forcible regeneration of the exhaust gas purification device 42. The shuttle valve 45 is arranged in a line that leads the pressure at the load port 26*a* of the flow rate/direction control valve 6*a* to the shuttle valve 9*a*. The shuttle valve 45 selects the higher one from the pressure at the load port 26*a* and external pressure (explained later) and outputs the selected higher pressure. The solenoid selector valve 46 (first selector valve) selects between the tank pressure and delivery pressure of the pilot pump 30 in a pilot line 31*a* (part of the pilot pressure supply line 31 upstream of the engine revolution speed detecting valve 13), outputs the selected pressure, and supplies the output pressure to the shuttle valve 45 as the aforementioned external pressure. The solenoid selector valve 48 (second selector valve) is arranged in the line 12*b* which leads the output pressure of the differential pressure reducing valve 11 to the pressure receiving part 17*e* of the LS control valve 17*b*. The solenoid selector valve 48 selects between the tank pressure and the output pressure of the differential pressure reducing valve 11 (absolute pressure of the differential pressure between the delivery pressure of the main pump 2 and the maximum load pressure) and supplies the selected pressure to the pressure receiving part 17*e* of the LS control valve 17*b*. The controller 49 (control device) receives a detection signal from the exhaust resistance sensor 43 and a command signal from the forcible regeneration switch 44, executes a prescribed calculation process, and outputs electric signals for switching the solenoid selector valves 46 and 48.

The exhaust gas purification device 42 collects the particulate matter (PM) contained in the exhaust gas by using a filter installed therein. The exhaust gas purification device 42 is equipped with an oxidation catalyst. When the exhaust gas temperature exceeds a prescribed temperature, the oxidation catalyst is activated and causes combustion of unburned fuel added to the exhaust gas, by which the exhaust gas temperature is increased and the PM collected and accumulated on the filter is combusted.

The exhaust resistance sensor 43 is, for example, a differential pressure detecting device which detects the differential pressure between the upstream side and the downstream side of the filter of the exhaust gas purification device 42 (i.e., exhaust resistance of the exhaust gas purification device 42).

The solenoid selector valve 46 is situated at the illustrated position and outputs the tank pressure as the external pressure when the electric signal outputted from the controller 49 is OFF. When the electric signal turns ON, the solenoid selector valve 46 is switched from the illustrated position and outputs the delivery pressure of the pilot pump 30 (predetermined pressure) as the external pressure. The solenoid selector valve 48 is situated at the illustrated position and outputs the output pressure of the differential pressure reducing valve 11 (absolute pressure of the differential pressure between the delivery pressure of the main pump 2 and the maximum load pressure) as the external pressure when the electric signal outputted from the controller 49 is OFF. When the electric signal turns ON, the solenoid selector valve 48 is switched from the illustrated position and outputs the tank pressure.

The pilot pressure supply line 31 is provided with the engine revolution speed detecting valve 13 which outputs pressure proportional to the engine revolution speed as the absolute pressure Pgr. The pressure in the pilot line 31*a* (as the pressure upstream of the engine revolution speed detecting valve 13) is kept at a level as the sum total of the pressure in the pilot line 31*b* (e.g., 3.9 MPa) determined by the pilot relief valve 32 and the absolute pressure Pgr (e.g., 2.0 MPa) outputted by the engine revolution speed detecting valve 13 (e.g., 3.9 MPa+2.0 MPa=5.9 MPa). This delivery pressure of the pilot pump 30 (e.g., 5.9 MPa) is at a level at which pressure (approximately 10 MPa) as the sum total of the delivery pressure (e.g., 5.9 MPa), the preset pressure (e.g., 2.0 MPa) of the unload valve 15 and pressure (e.g., 2.0 MPa) of the override characteristic of the unload valve 15 is equal to or higher than the pressure around the main pump's transition point from the constant maximum displacement characteristic to the constant maximum absorption torque characteristic implemented by the torque control tilting piston 17*a* (approximately 10 MPa) when all the control levers are at the neutral positions. This makes it possible to carry out pump absorption torque increasing control (explained later) with the maximum torque Tmax employing the constant absorption torque control conducted by the torque control tilting piston 17*a*, by outputting the delivery pressure of the pilot pump 30 as dummy load pressure when all the control levers are at the neutral positions.

Figure 4:
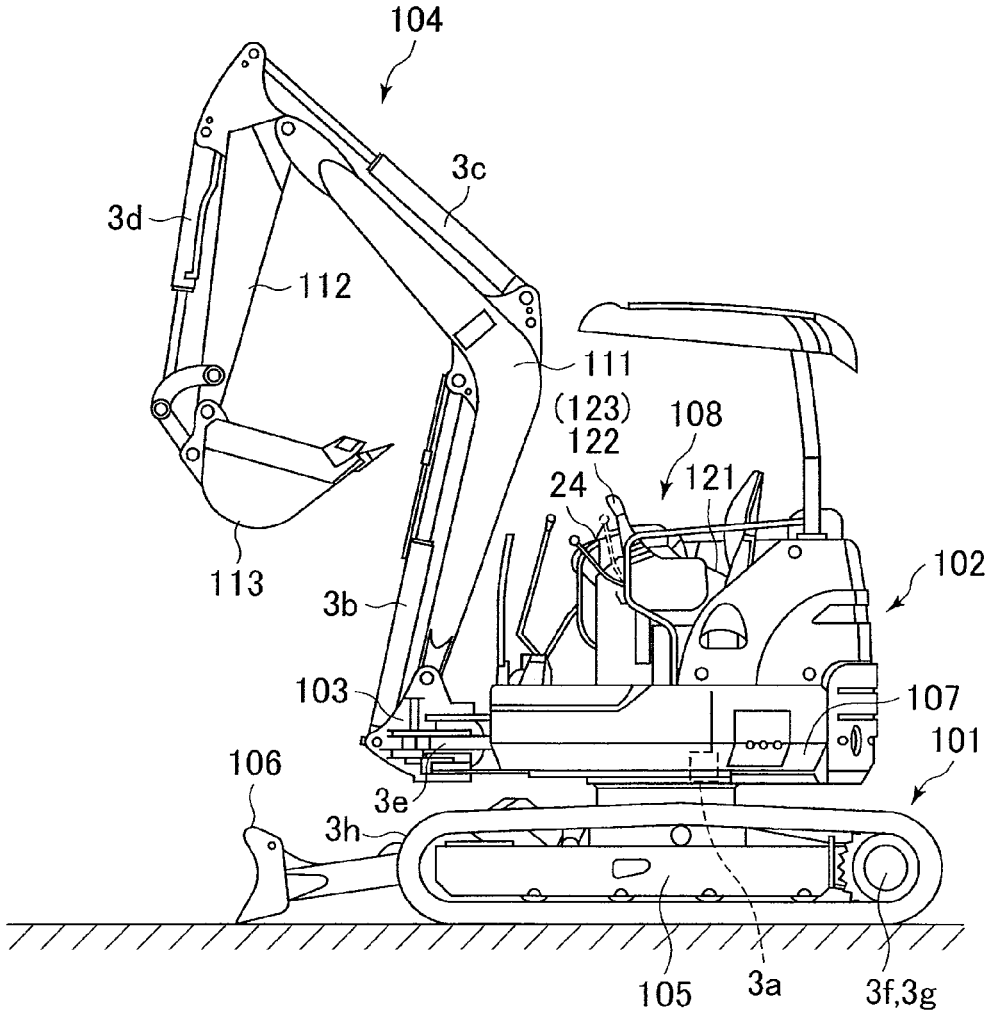
FIG. 4 is a schematic diagram showing the external appearance of a hydraulic shovel in which the hydraulic drive system in accordance with the embodiment is installed.

FIG. 4 is a schematic diagram showing the external appearance of the hydraulic shovel in which the hydraulic drive system in accordance with this embodiment is installed.

The hydraulic shovel comprises a lower track structure 101, an upper swing structure 102 mounted on the lower track structure 101 to be rotatable, and a front work implement 104 joined to the front end of the upper swing structure 102 via a swing post 103 to be rotatable vertically and horizontally. The lower track structure 101 is a track structure of a crawler type. An earth-removing blade 106 which is movable up and down is attached to the front of a track frame 105 of the lower track structure 101. The upper swing structure 102 includes a swing stage 107 forming a base structure and a cab 108 of a canopy type mounted on the swing stage 107. The front work implement 104 includes a boom 111, an arm 112 and a bucket 113. The proximal end of the boom 111 is connected to the swing post 103 with a pin. The distal end of the boom 111 is connected to the proximal end of the arm 112 with a pin. The distal end of the arm 112 is connected to the bucket 113 with a pin.

The upper swing structure 102 is driven and rotated with respect to the lower track structure 101 by the swing motor 3*a*. The boom 111, the arm 112 and the bucket 113 are rotated vertically by the expansion and contraction of a boom cylinder 3*b*, an arm cylinder 3*c* and a bucket cylinder 3*d*, respectively. Crawlers of the lower track structure 101 are driven and rotated by right and left track motors 3*f* and 3*g*. The blade 106 is driven up and down by a blade cylinder 3*h*. In FIG. 1, illustration of the bucket cylinder 3*d*, the right and left track motors 3*f* and 3*g*, the blade cylinder 3*h* and their circuit elements is omitted for brevity.

The cab 108 is equipped with a cab seat 121, the control lever units 122 and 123 (only the left side is shown in FIG. 4) and the gate lock lever 24.

Figure 5:
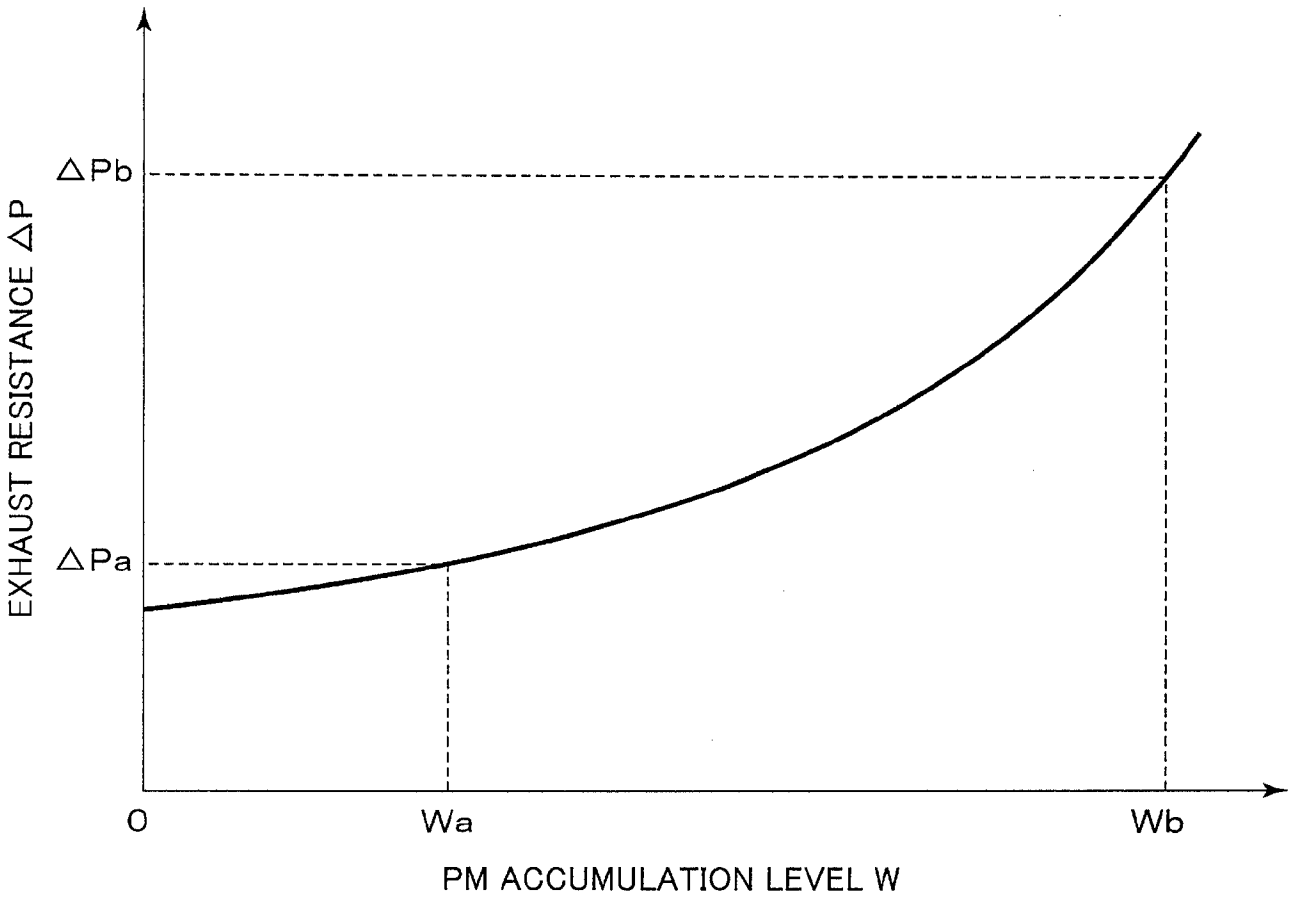
FIG. 5 is a graph showing the relationship between the amount of PM (Particulate Matter) accumulated in an exhaust gas purification device and exhaust resistance (differential pressure across a filter) detected by an exhaust resistance sensor.

FIG. 5 is a graph showing the relationship between the amount of PM accumulated in the exhaust gas purification device 42 (PM accumulation level) and the exhaust resistance (differential pressure across the filter) detected by the exhaust resistance sensor 43.

As shown in FIG. 5, the exhaust resistance of the exhaust gas purification device 42 increases with the increase in the PM accumulation level in the exhaust gas purification device 42. In FIG. 5, "Wb" represents a PM accumulation level that needs automatic regeneration control, "APb" represents an exhaust resistance when the PM accumulation level equals Wb, "Wa" represents a PM accumulation level at which the regeneration control may be ended, and "APa" represents an exhaust resistance when the PM accumulation level equals Wa.

In a storage unit (unshown) of the controller 49, APb has been stored as a threshold value for starting the automatic regeneration control and APa has been stored as a threshold value for ending the regeneration control.

Figure 6:
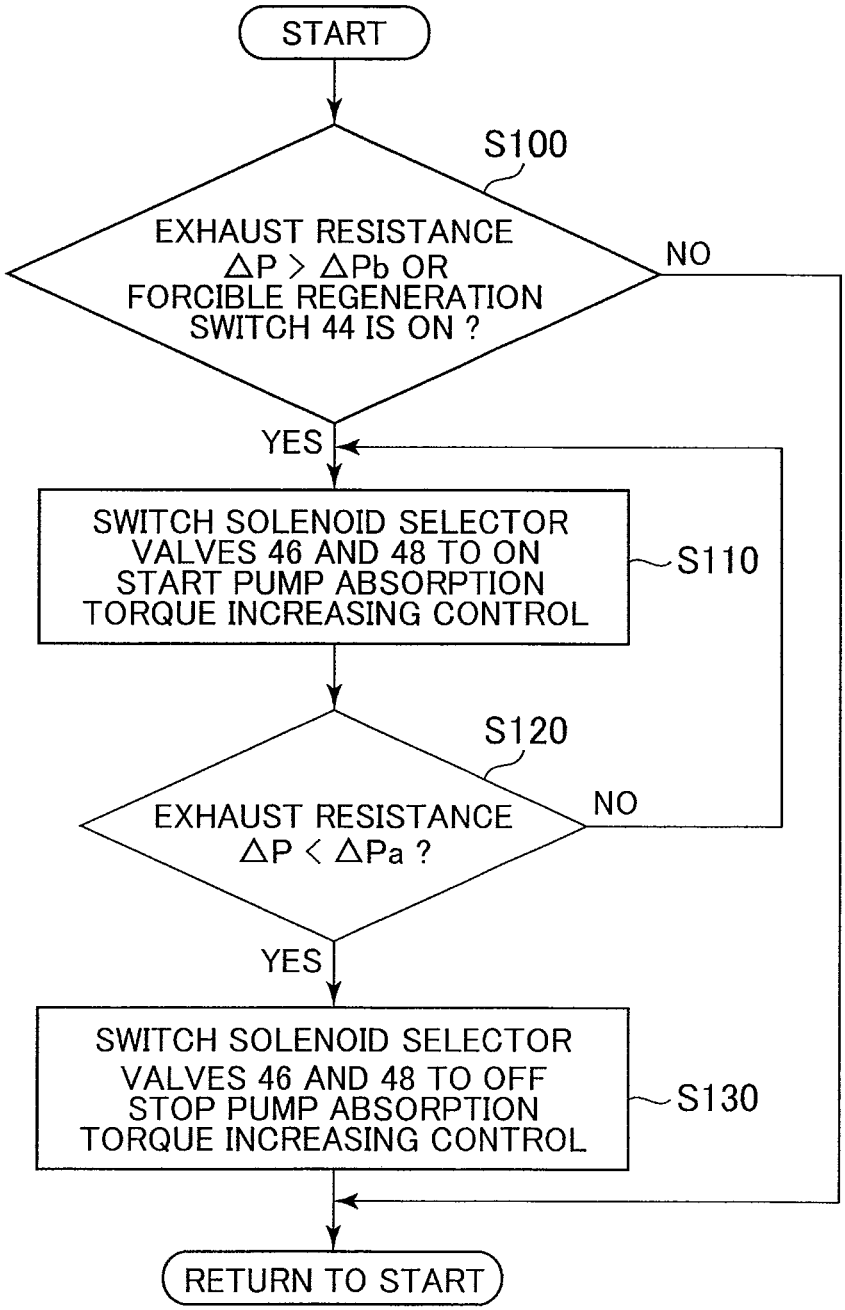
FIG. 6 is a flow chart showing processing functions of a controller.

FIG. 6 is a flow chart showing the processing functions of the controller 49. The procedure of the regeneration process for the exhaust gas purification device 42 conducted by the controller 49 will be explained below referring to FIG. 6.

First, based on the detection signal from the exhaust resistance sensor 43 and the command signal from the forcible regeneration switch 44, the controller 49 judges whether the exhaust resistance ΔP in the exhaust gas purification device 42 is higher than the threshold value ΔPb for starting the automatic regeneration control (ΔP>ΔPb) or not, while also judging whether or not the forcible regeneration switch 44 has been switched from OFF to ON (step S100). If ΔP>ΔPb holds or the forcible regeneration switch 44 is ON, the process advances to the next step. If ΔP>ΔPb does not hold and the forcible regeneration switch 44 is not ON, the judgment step is repeated without executing anything else.

When ΔP>ΔPb holds or the forcible regeneration switch 44 is ON, the controller 49 starts the pump absorption torque increasing control by switching the solenoid selector valves 46 and 48 from the illustrated positions by turning ON the electric signals outputted to the solenoid selector valves 46 and 48 (step S110). The controller 49 also executes a process for supplying unburned fuel to the exhaust gas. This process is executed by, for example, performing post-injection (additional injection) in the expansion stroke (after the main injection) by controlling the electronic governor (unshown) of the engine 1.

The pump absorption torque increasing control is a process for increasing the absorption torque of the main pump 2 by controlling the delivery pressure and the displacement of the main pump 2 (explained later). The output power (horsepower) of the main pump 2 also increases with the increase in the absorption torque of the main pump 2. Therefore, the pump absorption torque increasing control is synonymous with pump output power increasing control.

After the start of the pump absorption torque increasing control, the temperature of the exhaust gas from the engine 1 rises due to the increase in the hydraulic load on the engine 1, by which the oxidation catalyst installed in the exhaust gas purification device 42 is activated. By supplying the unburned fuel to the exhaust gas in such a condition, combustion of the unburned fuel is caused by the activated oxidation catalyst, the temperature of the exhaust gas is increased, and the PM accumulated on the filter is combusted and removed by the high-temperature exhaust gas.

Incidentally, the supply of the unburned fuel may also by implemented by equipping the exhaust pipe with a fuel injection unit for the regeneration control and activating the fuel injection unit.

During the pump absorption torque increasing control, the controller 49 judges whether the exhaust resistance ΔP in the exhaust gas purification device 42 has fallen below the threshold value ΔPa for ending the automatic regeneration control (ΔP<ΔPa) or not based on the detection signal from the exhaust resistance sensor 43 of the exhaust gas purification device 42 (step S120). If ΔP<ΔPa does not hold, the controller 49 returns to the step S110 and continues the pump absorption torque increasing control. If ΔP<ΔPa holds, the controller 49 stops the pump absorption torque increasing control by switching the solenoid selector valves 46 and 48 to the illustrated positions by turning OFF the electric signals outputted to the valves 46 and 48 (step S130). At the same time, the controller 49 stops the supply of the unburned fuel.

<<Operation>>

Next, the operation of this embodiment, including the details of the pump absorption torque increasing control (pump output power increasing control), will be described below.

1. When all Control Levers are at Neutral Positions and Solenoid Selector Valves 46 and 48 are OFF First, when all the control levers (control levers of the control lever units 122, 123, etc.) are at the neutral positions and the judgment in the step S100 in FIG. 6 is negative, the solenoid selector valves 46 and 48 are situated at the illustrated positions. When the solenoid selector valve 46 is at the illustrated position, the solenoid selector valve 46 outputs the tank pressure as the external pressure, and the tank pressure is lead to the shuttle valve 45. When all the control levers are at the neutral positions, the flow rate/direction control valves 6*a*, 6*b*, 6*c* . . . are held at the illustrated neutral positions and the pressures at their load ports 26*a*, 26*b*, 26*c* . . . also equal the tank pressure. Therefore, the maximum load pressure detected by the shuttle valve 45 and the shuttle valves 9*a*, 9*b*, 9*c* . . . also equals the tank pressure. Meanwhile, when the solenoid selector valve 48 is at the illustrated position, the solenoid selector valve 48 outputs the output pressure of the differential pressure reducing valve 11 (absolute pressure of the differential pressure between the delivery pressure of the main pump 2 and the maximum load pressure), and the output pressure is lead to the pressure receiving part 17*e* of the LS control valve 17*b*. Thus, the pressure that is lead to the pressure receiving part 17*e* of the LS control valve 17*b* equals the output pressure of the differential pressure reducing valve 11. Therefore, the operation of the hydraulic drive system in this case is equivalent to that in the conventional systems, with the tilting angle (displacement) and the delivery flow rate of the main pump 2 at their minimums. The delivery pressure of the main pump 2, controlled by the unload valve 15, remains at minimum pressure which is substantially equal to the preset pressure of the unload valve 15. Consequently, the absorption torque of the main pump 2 also remains at its minimum level.

Details of the operation of each component in this case are as follows:

The maximum load pressure detected by the shuttle valve 45 and the shuttle valves 9*a*, 9*b*, 9*c* . . . equals the tank pressure. The differential pressure reducing valve 11 outputs the difference (as absolute pressure) between the delivery pressure of the main pump 2 (pressure in the supply line 5) and the tank pressure. The output pressure of the differential pressure reducing valve 11 and the output pressure of the engine revolution speed detecting valve 13 are lead to the LS control valve 17*b* of the pump control device 17. When the delivery pressure of the main pump 2 (pressure in the supply line 5) rises and exceeds the output pressure of the engine revolution speed detecting valve 13, the LS control valve 17*b* switches to a rightward position in the figure, by which the pressure supplied to the LS control tilting piston 17*c* of the main pump 2 increases and the tilting angle of the main pump 2 decreases. However, the main pump 2, having a stopper for setting its minimum tilting angle, is held at the minimum tilting angle and delivers its minimum flow rate.

Meanwhile, the supply line 5 is equipped with the unload valve 15 and the tank pressure (maximum load pressure) is lead to the pressure receiving part 15*c* of the unload valve 15. When the pressure in the supply line 5 exceeds the sum total of the tank pressure (maximum load pressure) and the preset pressure Pun of the spring 15*a*, the unload valve 15 shifts to the open state and returns the hydraulic fluid in the supply line 5 to the tank T, thereby restricting the increase of the pressure in the supply line 5.

Figure 7:
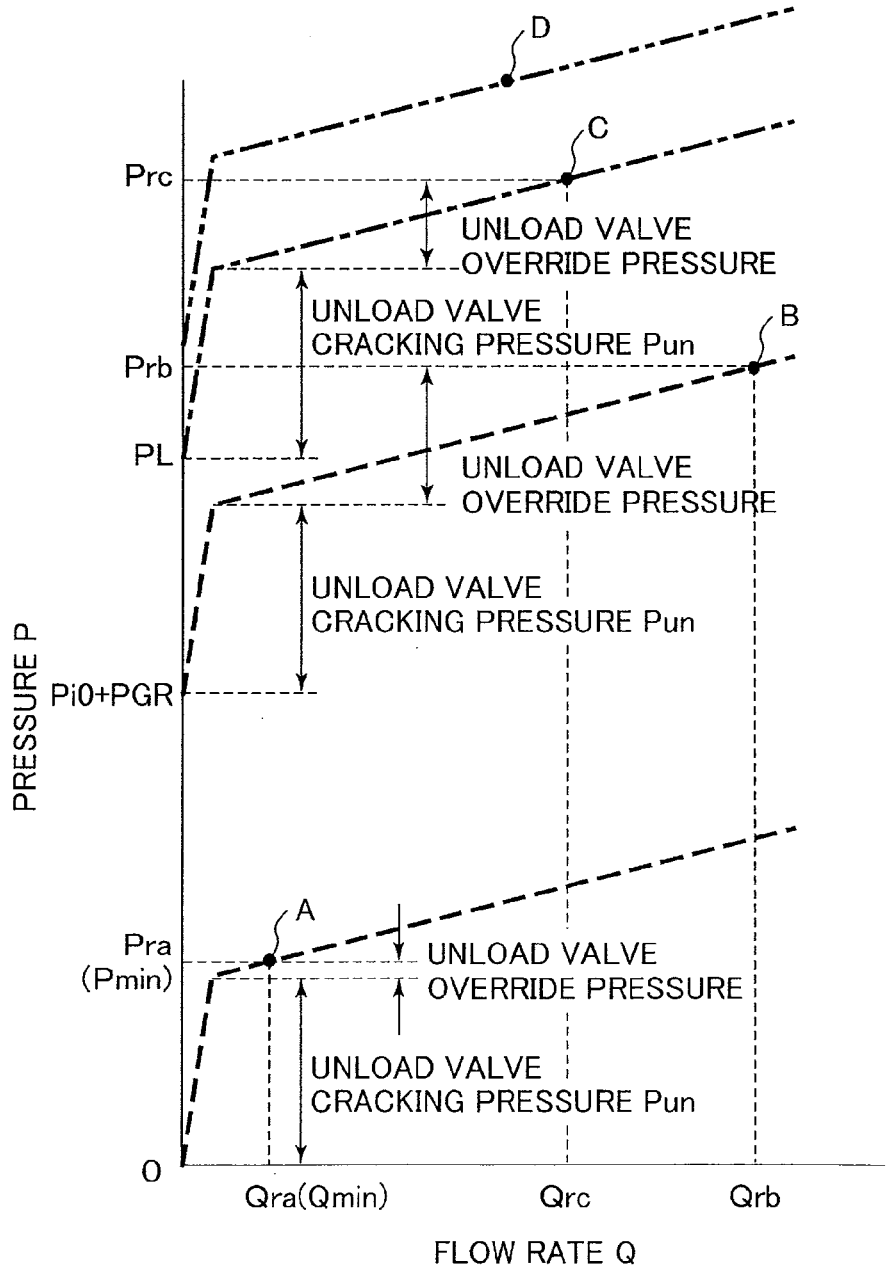
FIG. 7 is a graph showing performance characteristics of an unload valve when tank pressure is assumed to be 0 MPa.

FIG. 7 is a graph showing performance characteristics of the unload valve 15 when the tank pressure is assumed to be 0 MPa. In FIG. 7, the relationship between the passage flow rate in the supply line 5 (delivery flow rate of the main pump 2) and the pressure in the supply line 5 (delivery pressure of the main pump 2) when the tank pressure is lead to the pressure receiving part 15*c* of the unload valve 15 is indicated with a broken line. As indicated by the point A in FIG. 7, the pressure in the supply line 5 is controlled to be at Pra as the sum total of the tank pressure (0 MPa) detected as the maximum load pressure, the preset pressure (cracking pressure) Pun of the unload valve 15 and the override characteristic pressure of the unload valve 15.

For example, the absolute pressure Pgr which is outputted by the engine revolution speed detecting valve 13 as the load sensing target differential pressure is assumed to be 2.0 MPa, and the preset pressure (cracking pressure) Pun of the unload valve 15 is assumed to be equal (2.0 MPa) to the absolute pressure Pgr (load sensing target differential pressure) outputted by the differential pressure reducing valve 13*b*. The override characteristic of the unload valve 15 changes depending on the delivery flow rate of the main pump 2. Since the delivery flow rate of the main pump 2 is the minimum flow rate Qra (Qmin) in this case, the override characteristic pressure of the unload valve 15 is slight. Consequently, the pressure Pra in the supply line 5 (delivery pressure of the main pump 2) becomes slightly higher than 2.0 MPa. This pressure, which is indicated by the point A in FIGS. 2 and 3, corresponds to the minimum pressure Pmin. The absorption torque of the main pump 2 in this case equals the minimum torque Tmin.

2. When all Control Levers are at Neutral Positions and Solenoid Selector Valves 46 and 48 are ON When the regeneration of the exhaust gas purification device 42 becomes necessary and the judgment in the step S100 in FIG. 6 turns affirmative when all the control levers (control levers of the control lever units 122, 123, etc.) are at the neutral positions, the solenoid selector valves 46 and 48 are switched from the illustrated positions by the electric signals turning ON.

The part (pilot line) 31*b* of the pilot pressure supply line 31 is equipped with the pilot relief valve 32, which keeps the pressure in the pilot hydraulic fluid line 31*b* at a fixed pressure (e.g., 3.9 MPa). Further, the pilot pressure supply line 31 is equipped with the engine revolution speed detecting valve 13 which outputs the pressure proportional to the engine revolution speed as the absolute pressure Pgr. The delivery pressure of the pilot pump 30 (pressure in the pilot line 31*a*) situated upstream of the engine revolution speed detecting valve 13 is kept at the sum total of the pressure in the pilot line 31*b* (e.g., 3.9 MPa), which is determined by set pressure Pio of the pilot relief valve 32, and the absolute pressure Pgr (e.g., 2.0 MPa) outputted by the engine revolution speed detecting valve 13 (e.g., 3.9 MPa+2.0 MPa=5.9 MPa).

When the solenoid selector valve 46 is switched from the illustrated position, the solenoid selector valve 46 outputs the delivery pressure of the pilot pump 30 and the pressure is lead to the shuttle valve 45. Thus, the higher one of the maximum load pressure of the actuators 3*a*, 3*b*, 3*c* . . . and the delivery pressure of the pilot pump 30 is selected as the maximum load pressure detected by the shuttle valve 45 and the shuttle valves 9*a*, 9*b*, 9*c* . . . . Since all the control lever units are at the neutral positions and the pressures at the load ports 26*a*, 26*b*, 26*c* . . . of the flow rate/direction control valves 6*a*, 6*b*, 6*c* . . . equal the tank pressure in this case, the delivery pressure of the pilot pump 30 is detected as the maximum load pressure and the pressure is lead to the pressure receiving part 15*c* of the unload valve 15 as the dummy load pressure.

The solid line in FIG. 7 indicates the relationship between the passage flow rate in the supply line 5 (delivery flow rate of the main pump 2) and the pressure in the supply line 5 (delivery pressure of the main pump 2) when the dummy load pressure is lead to the pressure receiving part 15*c* of the unload valve 15. As indicated by the point B in FIG. 7, the pressure in the supply line 5 is controlled to be at Prb as the sum total of the dummy load pressure (delivery pressure of the pilot pump 30), the preset pressure (cracking pressure) Pun of the unload valve 15 and the override characteristic pressure of the unload valve 15.

The set pressure Pio of the pilot relief valve 32 is assumed to be 3.9 MPa, for example. As mentioned above, the absolute pressure Pgr outputted by the engine revolution speed detecting valve 13 as the load sensing target differential pressure is assumed to be 2.0 MPa and the preset pressure (cracking pressure) Pun of the unload valve 15 is assumed to be equal (2.0 MPa) to the absolute pressure Pgr (load sensing target differential pressure). Further, the override characteristic pressure of the unload valve 15 in this case is assumed to be approximately 2.0 MPa. In this case, the pressure Prb in the supply line 5 (delivery pressure of the main pump 2) reaches approximately 10 MPa.

Meanwhile, when the solenoid selector valve 48 is switched from the illustrated position, the pressure receiving part 17*e* of the LS control valve 17*b* governing the load sensing control of the main pump 2 is supplied with the tank pressure, by which the LS control valve 17*b* is switched to a leftward position in the figure. By the switching, the load sensing control is disabled, the hydraulic fluid for the LS control tilting piston 17*c* is returned to the tank T via the LS control valve 17*b*, the tilting angle (displacement) of the main pump 2 is increased by spring force, and the delivery flow rate of the main pump 2 is increased.

In construction machines such as hydraulic shovels, the pressure P0 at the turning point of the Pq (pressure—pump displacement) characteristic of the main pump 2 (determined by the torque control tilting piston 17*a*) is set around 10 MPa in many cases. Consequently, the delivery pressure of the main pump 2 when the solenoid selector valves 46 and 48 have been switched from the illustrated positions (Prb in FIGS. 2, 3 and 7) becomes approximately equal to the pressure at the turning point of the Pq characteristic of the main pump 2. As indicated by the point B in FIG. 2, the displacement of the main pump 2 equals qb which is determined by the constant absorption torque control conducted by the torque control tilting piston 17*a*, and the delivery flow rate of the main pump 2 equals Qrb at the point B in FIG. 7. The absorption torque of the main pump 2 in this case equals the maximum torque Tmax as indicated by the point B in FIG. 3.

As above, by the switching of the solenoid selector valves 46 and 48, the absorption torque of the main pump 2 increases to the maximum torque Tmax of the constant absorption torque control. Thus, the pump absorption torque increasing control with the maximum torque Tmax employing the constant absorption torque control by the torque control tilting piston 17*a* can be carried out.

When the absorption torque of the main pump 2 increases as above, the load on the engine 1 increases accordingly and the exhaust temperature rises. Since the oxidation catalyst installed in the exhaust gas purification device 42 is activated by the high temperature, the unburned fuel supplied to the exhaust gas is combusted due to the activated oxidation catalyst, the temperature of the exhaust gas is increased, and the PM accumulated on the filter is combusted and removed by the high-temperature exhaust gas as explained above.

This absorption torque increasing control is continued until the exhaust resistance ΔP in the exhaust gas purification device 42 detected by the exhaust resistance sensor 43 of the exhaust gas purification device 42 falls below the threshold value ΔPa.

3. When Control Lever is Operated while Solenoid Selector Valves 46 and 48 are ON Next, a case where a control lever is operated during the regeneration in the above state 2 (with the solenoid selector valves 46 and 48 ON) will be explained below.

When a control lever for any one of the actuators (assumed here to be the control lever for the boom, for example) is operated, the flow rate/direction control valve 6*b* is switched, the hydraulic fluid is supplied to the boom cylinder 3*b*, and the boom cylinder 3*b* is driven. In this case, the pressure at the load port 26*b* of the flow rate/direction control valve 6*b* equals the load pressure of the boom cylinder 3*b*.

Since the solenoid selector valves 46 and 48 have already been switched from the illustrated positions, the maximum load pressure detected by the shuttle valve 45 and the shuttle valves 9*a*, 9*b*, 9*c* . . . equals the higher one of the load pressure of the boom cylinder 3*b* and the delivery pressure of the pilot pump 30.

First, a case where the load pressure of the boom cylinder 3*b* is lower than the delivery pressure of the pilot pump 30 will be explained.

In the case where the load pressure of the boom cylinder 3*b* is lower than the delivery pressure of the pilot pump 30, the delivery pressure of the pilot pump 30 as the maximum load pressure is detected as the dummy load pressure and the dummy load pressure is lead to the pressure receiving part 15*c* of the unload valve 15 similarly to the above case 2 where all the control levers are at the neutral positions. In this case, the delivery pressure of the main pump 2 is kept at the same level as that before the actuator operation thanks to the function of the unload valve 15. Since the solenoid selector valve 48 has already been switched from the illustrated position, the tank pressure is lead to the pressure receiving part 17*e* of the LS control valve 17*b* governing the load sensing control of the main pump 2, the load sensing control is disabled, the displacement of the main pump 2 increases, and the delivery flow rate of the main pump 2 increases similarly to the above case 2. Consequently, the delivery pressure of the main pump 2 (pressure in the supply line 5) and the delivery flow rate of the main pump 2 (passage flow rate in the supply line 5) are controlled as indicated by the point B in FIGS. 2 and 7 similarly to the control before the actuator operation. Thus, the pump absorption torque increasing control employing the constant absorption torque control, equivalent to that before the actuator operation, can be carried out.

Further, since the load sensing control is disabled and the delivery flow rate of the main pump 2 increases, a necessary amount (flow rate) of hydraulic fluid can be supplied to the boom cylinder 3*b* and the actuator operation can be performed without being affected by the pump absorption torque increasing control.

Furthermore, the flow rate through the flow rate/direction control valve 6*b* (i.e., the driving speed of the boom cylinder 3*b*) is controlled according to the operation amount of the control lever, since the flow rate through the flow rate/direction control valve 6*b* is determined by the opening area of the meter-in throttle of the flow rate/direction control valve 6*b* and the differential pressure across the meter-in throttle which is controlled to be equal to the output pressure of the differential pressure reducing valve 11 by the pressure compensating valve 7*b*.

Next, a case where the load pressure of the boom cylinder 3*b* is higher than the delivery pressure of the pilot pump 30 will be explained.

In the case where the load pressure of the boom cylinder 3*b* is higher than the delivery pressure of the pilot pump 30, the load pressure PL on the boom cylinder 3*b* is detected as the maximum load pressure, and the load pressure PL is lead to the pressure receiving part 15*c* of the unload valve 15. Thus, as indicated by the point C in FIG. 7, the pressure in the supply line 5 (delivery pressure of the main pump 2) is controlled to be at Prc as the sum total of the load pressure PL of the boom cylinder 3*b*, the preset pressure (cracking pressure) Pun of the unload valve 15 and the override characteristic pressure of the unload valve 15. The pressure Prc is higher than the pressure Prb in the case where all the control levers are at the neutral positions. Meanwhile, since the solenoid selector valve 48 has already been switched from the illustrated position, the tank pressure is lead to the pressure receiving part 17*e* of the LS control valve 17*b* governing the load sensing control of the main pump 2, the load sensing control is disabled, and the displacement of the main pump 2 increases similarly to the above case 2.

Consequently, the absorption torque of the main pump 2 is controlled so as not to exceed the maximum torque Tmax by the constant absorption torque control conducted by the torque control tilting piston 17*a* (torque control unit), the displacement of the main pump 2 reaches a value qc (point C in FIG. 2) which is determined by the constant absorption torque control by the torque control tilting piston 17*a*, and the delivery flow rate of the main pump 2 reaches a value Qrc (point C in FIG. 7). Therefore, the pump absorption torque increasing control, equivalent to that before the actuator operation, can be carried out without being affected by the actuator operation.

Meanwhile, the actuator operation can be performed without being affected by the pump absorption torque increasing control since the delivery pressure of the main pump 2 increases according to the load pressure.

Furthermore, the flow rate through the flow rate/direction control valve 6*b* (i.e., the driving speed of the boom cylinder 3*b*) is controlled according to the operation amount of the control lever since the flow rate through the flow rate/direction control valve 6*b* is determined by the opening area of the meter-in throttle of the flow rate/direction control valve 6*b* and the differential pressure across the meter-in throttle which is controlled to be equal to the output pressure of the differential pressure reducing valve 11 by the pressure compensating valve 7*b*.

The above explanation of the operation applies also to cases where a different control lever (other than that for the boom) is operated separately.

Next, a case where control levers for two or more actuators are operated at the same time will be explained below.

In the case where control levers for two or more actuators (assumed here to be the control levers for the boom and the arm, for example) are operated at the same time, the flow rate/direction control valves 6*b* and 6*c* are switched and the boom cylinder 3*b* and the arm cylinder 3*c* are supplied with the hydraulic fluid and driven.

Since the solenoid selector valve 46 has already been switched from the illustrated position, the maximum load pressure detected by the shuttle valve 45 and the shuttle valves 9*a*, 9*b*, 9*c* . . . equals the higher one selected from the delivery pressure of the pilot pump 30 and the load pressure of the boom cylinder 3*b* and the arm cylinder 3*c*.

When the load pressure of the boom cylinder 3*b* and the arm cylinder 3*c* is lower than the delivery pressure of the pilot pump 30, the delivery pressure of the pilot pump 30 as the maximum load pressure is detected as the dummy load pressure. Therefore, the control of the main pump's delivery pressure (pressure in the supply line 5), displacement and delivery flow rate (passage flow rate in the supply line 5) in this case is conducted similarly to the aforementioned case where one actuator is operated separately and the load pressure of the actuator is lower than the dummy load pressure.

When the load pressure of the boom cylinder 3*b* and the arm cylinder 3*c* is higher than the delivery pressure of the pilot pump 30, the higher one (PLH) selected from the load pressure of the boom cylinder 3*b* and the load pressure of the arm cylinder 3*c* is detected as the maximum load pressure, and the load pressure PLH is lead to the pressure receiving part 15*c* of the unload valve 15. The control of the main pump's delivery pressure (pressure in the supply line 5), displacement and delivery flow rate (passage flow rate in the supply line 5) in this case is conducted similarly to the aforementioned case where one actuator is operated separately and the load pressure of the actuator is higher than the dummy load pressure. The delivery pressure, the displacement and the delivery flow rate of the main pump 2 are controlled depending on the magnitude of the load pressure PLH at that time as indicated by the point D in FIGS. 2 and 7, for example. The absorption torque of the main pump 2 is controlled to be approximately equal to the maximum torque Tmax as indicated by the point D in FIG. 3.

The flow rate through each flow rate/direction control valve 6*b*, 6*c* is determined by the opening area of the meter-in throttle of the valve 6*b*, 6*c* and the differential pressure across the meter-in throttle. The differential pressure across the meter-in throttle of each flow rate/direction control valve 6*b*, 6*c* is controlled to be equal to the output pressure of the differential pressure reducing valve 11 by each pressure compensating valve 7*b*, 7*c*. Therefore, the hydraulic fluid can be supplied to the boom cylinder 3*b* and the arm cylinder 3*c* at a flow rate ratio corresponding to the opening areas of the meter-in throttling portions of the flow rate/direction control valves 6*b* and 6*c*, irrespective of the magnitude of the load pressure of each cylinder 3*b*, 3*c*.

Further, even if the saturation state (in which the delivery flow rate of the main pump 2 is less than the sum total of the flow rates demanded by the flow rate/direction control valves 6*b* and 6*c*) occurs at this time, the output pressure of the differential pressure reducing valve 11 (differential pressure between the delivery pressure of the main pump 2 and the maximum load pressure of the actuators 3*a*, 3*b*, 3*c* . . . ) decreases depending on the degree of the saturation, and the target compensation differential pressure of the pressure compensating valves 7*a*, 7*b*, 7*c* . . . also decreases accordingly. Therefore, the delivery flow rate of the main pump 2 can be redistributed at the ratio between the flow rates demanded by the flow rate/direction control valves 6*b* and 6*c*.

The above explanation of the operation applies also to cases where other control levers (other than those for the boom and the arm) are operated at the same time.

As described above, the pump absorption torque increasing control employing the constant absorption torque control can be carried out and the exhaust temperature can be raised thanks to the increase in the load on the engine 1 similarly to the case where there is no actuator operation, irrespective of how the actuators are operated during the regeneration of the exhaust gas purification device 42.

<<Effects>>

According to this embodiment configured as above, the following effects are achieved:

1. When the regeneration of the exhaust gas purification device 42 has become necessary due to the increase in the PM accumulation level of the filter in the exhaust gas purification device 42, the controller 49 switches the solenoid selector valves 46 and 48, the solenoid selector valve 46 outputs the delivery pressure of the pilot pump 30 (predetermined pressure) as the dummy load pressure, and the solenoid selector valve 48 disables the load sensing control. Consequently, as explained above, the absorption torque of the main pump 2 increases to the maximum torque Tmax of the constant absorption torque control conducted by the torque control tilting piston 17*a* even when the control levers are at the neutral positions and there is no actuator operation. In short, the pump absorption torque increasing control (pump output power increasing control) employing the constant absorption torque control is carried out. When the absorption torque of the main pump 2 increases as above, the load on the engine 1 increases, the exhaust temperature rises, and the filter deposits in the exhaust gas purification device 42 can be combusted and removed efficiently.

2. Even when an actuator operation of a low load and a high flow rate (e.g., arm crowd operation using the arm cylinder 3*c*) is performed during the pump absorption torque increasing control and hydraulic fluid delivered from the main pump 2 flows into the actuator, the pump control device 17 continues the control for increasing the displacement of the main pump 2 within the maximum torque of the constant absorption torque control conducted by the torque control tilting piston 17*a* (torque control unit) since the load sensing control has been disabled. Consequently, a necessary amount (flow rate) of hydraulic fluid can be supplied to the actuator and the actuator operation can be performed without being affected by the pump absorption torque increasing control.

Further, even in the case where the load pressure of the actuator(s) is lower than the dummy load pressure (predetermined pressure), the dummy load pressure is selected as the maximum load pressure and the delivery pressure of the main pump 2 is kept at the same level as that before the actuator operation thanks to the function of the unload valve 15. Thus, the delivery pressure of the main pump 2 is prevented from being affected by the actuator operation and dropping. Consequently, the pump absorption torque increasing control equivalent to that before the actuator operation can be carried out.

When an actuator operation of a high load and a low flow rate (e.g., bucket dump operation using the bucket cylinder 3*d*) is performed during the pump absorption torque increasing control, the load pressure of the actuator is selected as the maximum load pressure by the maximum load pressure detecting circuit implemented by the shuttle valves 9*a*, 9*b*, 9*c* . . . and the delivery pressure of the main pump 2 increases depending on the load pressure of the actuator thanks to the function of the unload valve 15. In this case, the absorption torque of the main pump 2 is controlled not to exceed the maximum torque Tmax by the constant absorption torque control conducted by the torque control tilting piston 17*a* (torque control unit). Consequently, the pump absorption torque increasing control equivalent to that before the actuator operation can be carried out without being affected by the actuator operation. Meanwhile, the actuator operation can be performed without being affected by the pump absorption torque increasing control since the delivery pressure of the main pump 2 increases according to the load pressure.

As above, the interaction (interference) between the actuator operation and the pump absorption torque increasing control (pump output power increasing control) is eliminated even when they are conducted at the same time. Consequently, the deterioration in the operability of the actuators (caused by the pump absorption torque increasing control) and the occurrence of trouble in the pump absorption torque increasing control (caused by the actuator operation) can be prevented.

3. The above effects can be achieved with ease and at a low cost since the solenoid selector valves 46 and 48 are relatively low-priced selector valves.

4. The solenoid selector valve 46 is configured to select between the tank pressure and the delivery pressure of the pilot pump 30 in the pilot line 31*a* (part of the pilot pressure supply line 31 upstream of the engine revolution speed detecting valve 13), output the selected pressure, and supply the output pressure to the shuttle valve 45 as the external pressure. Therefore, already-existing pressure can be utilized as the dummy load pressure (predetermined pressure) for the pump absorption torque increasing control and the cost for the system configuration can be reduced further.

5. The solenoid selector valve 48 is inserted in the line 12*b* (which leads the output pressure of the differential pressure reducing valve 11 to the pressure receiving part 17*e* of the LS control valve 17*b* of the pump control device 17) so as to select between the tank pressure and the output pressure of the differential pressure reducing valve 11 and supply the selected pressure to the pressure receiving part 17*e* of the LS control valve 17*b*. Therefore, the load sensing control can be stopped securely and the torque control can be conducted exclusively. Further, the switching (selection) of the enabling/disabling of the load sensing control can be implemented with a simple configuration.

Second Embodiment

Figure 8:
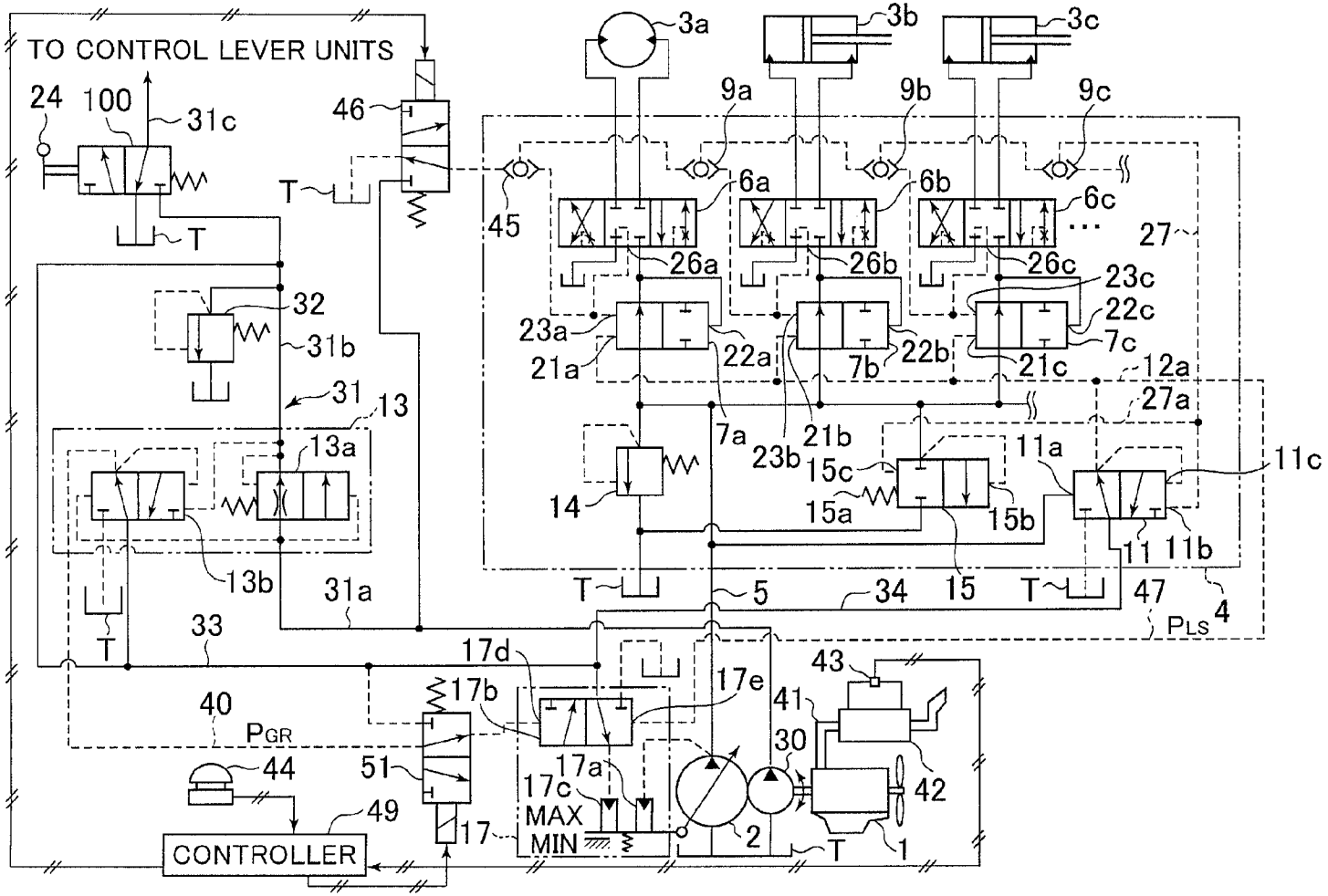
FIG. 8 is a schematic diagram showing the configuration of a hydraulic drive system in accordance with a second embodiment of the present invention.

A second embodiment of the present invention will be described below with reference to FIG. 8. FIG. 8 is a schematic diagram showing the configuration of a hydraulic drive system in accordance with the second embodiment of the present invention. This embodiment illustrates another example of the second selector valve which switches (selects) the enabling/disabling of the load sensing control.

Referring to FIG. 8, the hydraulic drive system comprises a solenoid selector valve 51 which is arranged in the line 40 leading the output pressure Pgr of the differential pressure reducing valve 13*b* of the engine revolution speed detecting valve 13 to the pressure receiving part 17*d* of the LS control valve 17*b*. The solenoid selector valve 51 selects between the output pressure Pgr of the differential pressure reducing valve 13*b* and the pressure in the pilot line 31*b* and supplies the selected pressure to the pressure receiving part 17*d* of the LS control valve 17*b*. The hydraulic drive system of this embodiment does not have the solenoid selector valve 48 which is arranged in the line 12*b* in the hydraulic drive system of FIG. 1. As mentioned above, the output pressure Pgr of the differential pressure reducing valve 13*b* is approximately 2.0 MPa and the pressure in the pilot line 31*b* is approximately 3.9 MPa, for example.

When $\Delta P > \Delta Pb$ holds or the forcible regeneration switch 44 is ON, the controller 49 turns ON the electric signals outputted to the solenoid selector valves 46 and 51 and thereby switches the valves 46 and 51 from the illustrated positions (step S110 in FIG. 6). When $\Delta P < \Delta Pa$ is satisfied, the controller 49 turns OFF the electric signals outputted to the solenoid selector valves 46 and 51 and thereby switches the valves 46 and 51 to the illustrated positions (step S130 in FIG. 6).

When the electric signal from the controller 49 is OFF, the solenoid selector valve 51 is situated at the illustrated position and outputs the output pressure Pgr of the differential pressure reducing valve 13*b* to the pressure receiving part 17*d* of the LS control valve 17*b* as the target differential pressure of the load sensing control. When the electric signal from the controller 49 turns ON, the solenoid selector valve 51 is switched from the illustrated position and outputs the pressure in the pilot line 31*b* to the pressure receiving part 17*d* of the LS control valve 17*b*. As mentioned above, the pressure in the pilot line 31*b* is approximately 3.9 MPa which is higher than the output pressure Pgr (2.0 MPa) of the differential pressure reducing valve 13*b*. This pressure (approximately 3.9 MPa) is higher than the output pressure of the differential pressure reducing valve 11 (differential pressure between the delivery pressure of the main pump 2 and the maximum load pressure) which is lead to the pressure receiving part 17*e* of the LS control valve 17*b*. Consequently, the LS control valve 17*b* is switched to the leftward position in the figure, the load sensing control is disabled, the LS control tilting piston 17*c* is connected with the tank T, and the tilting angle (displacement) of the main pump 2 is increased.

Thus, when the solenoid selector valves 46 and 51 are switched from the illustrated positions, the main pump's delivery pressure (pressure in the supply line 5), displacement and delivery flow rate (passage flow rate in the supply line 5) are controlled as indicated by the points B, C and D in FIGS. 2 and 7 and the absorption torque of the main pump 2 is controlled to be substantially equal to the maximum torque Tmax as indicated by the points B, C and D in FIG. 3, similarly to the first embodiment.

As above, also in this embodiment, the pump absorption torque increasing control can be conducted similarly to the first embodiment and effects equivalent to those of the first embodiment can be achieved.

Third Embodiment

Figure 9:
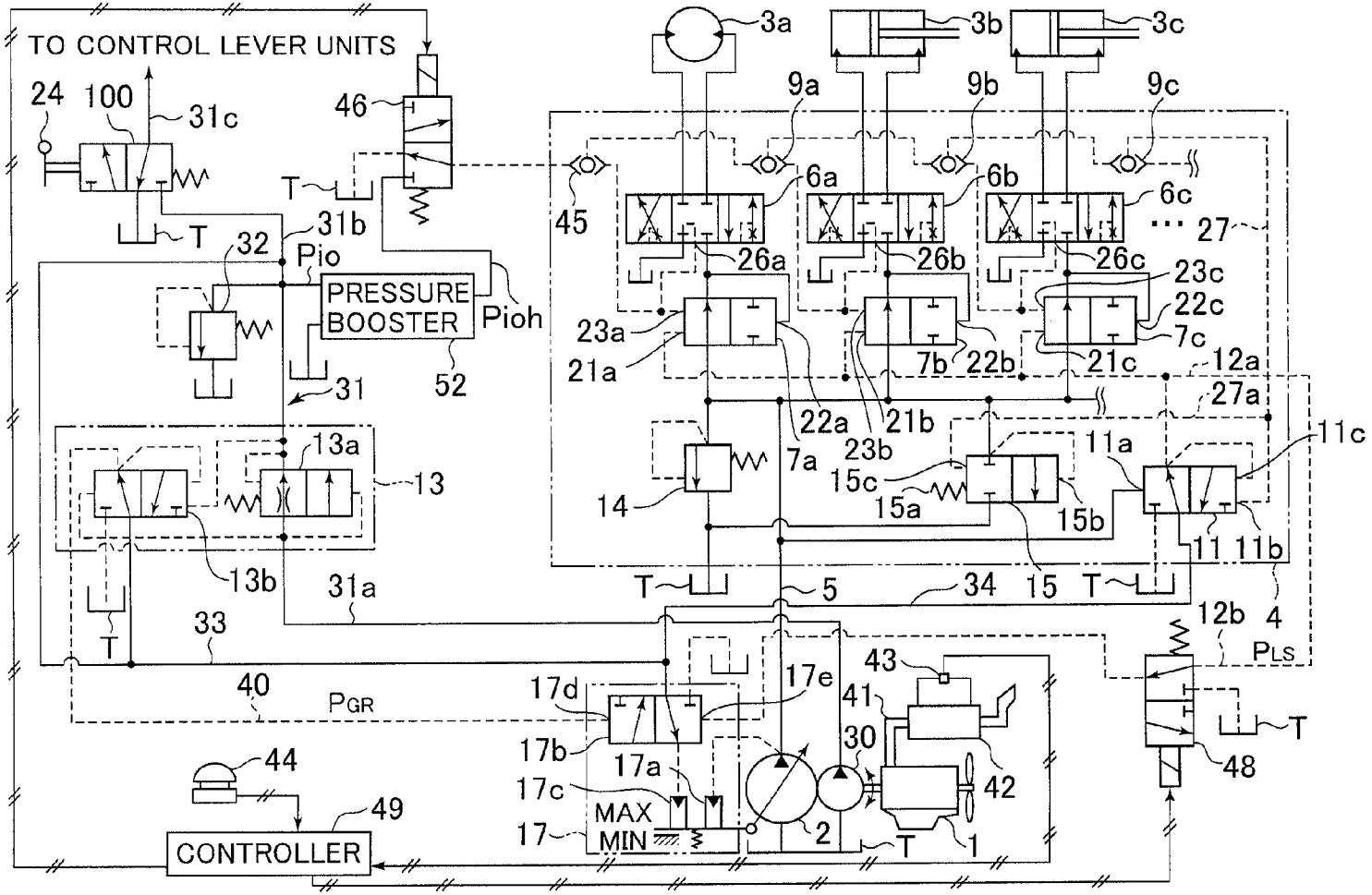
FIG. 9 is a schematic diagram showing the configuration of a hydraulic drive system in accordance with a third embodiment of the present invention.

A third embodiment of the present invention will be described below with reference to FIG. 9. FIG. 9 is a schematic diagram showing the configuration of a hydraulic drive system in accordance with the third embodiment of the present invention.

In the first and second embodiments, the delivery pressure of the pilot pump 30 is used as the "predetermined pressure" which is outputted as the dummy load pressure when the solenoid selector valve 46 is switched from the illustrated position. This embodiment illustrates another example of the source for generating the "predetermined pressure".

Referring to FIG. 9, the hydraulic drive system comprises a pressure booster 52 which boosts the pressure in the pilot line 31*b* generated by the pilot relief valve 32 (generally around 3.9 MPa as mentioned above) to the predetermined pressure. Instead of the delivery pressure of the pilot pump 30 (pressure in the pilot line 31*a*) used in the hydraulic drive system of FIG. 1, the output pressure Pioh of the pressure booster 52 is supplied to the solenoid selector valve 46 as one of its inputs.

The predetermined pressure outputted by the pressure booster 52 has been set so that the sum total of the predetermined pressure, the preset pressure (cracking pressure) Pun of the unload valve 15 and the override characteristic pressure of the unload valve 15 is equal to or higher than the pressure around the transition point from the constant maximum displacement characteristic Tp0 to the constant maximum absorption torque characteristics Tp1 and Tp2 in the Pq (pressure—pump displacement) characteristic of the main pump 2 implemented by the torque control tilting piston 17*a*. In the illustrated example, the predetermined pressure outputted by the pressure booster 52 equals the delivery pressure of the pilot pump 30 (e.g., 5.9 MPa).

When $\Delta P > \Delta Pb$ holds or the forcible regeneration switch 44 is ON, the controller 49 turns ON the electric signals outputted to the solenoid selector valves 46 and 48 and thereby switches the valves 46 and 48 from the illustrated positions (step S110 in FIG. 6). When $\Delta P < \Delta Pa$ is satisfied, the controller 49 turns OFF the electric signals outputted to the solenoid selector valves 46 and 48 and thereby switches the valves 46 and 48 to the illustrated positions (step S130 in FIG. 6).

When situated at the illustrated position, the solenoid selector valve 46 outputs the tank pressure to the shuttle valve 45 as the dummy load pressure. After being switched from the illustrated position, the solenoid selector valve 46 outputs the output pressure Pioh of the pressure booster 52 to the shuttle valve 45 as the dummy load pressure.

Also in this embodiment configured as above, the pump absorption torque increasing control can be conducted similarly to the first embodiment and effects equivalent to those of the first embodiment can be achieved.

Further, this embodiment makes it possible to employ relatively low pressure (generated by the pilot relief valve 32) as the dummy load pressure when all the control levers are at the neutral positions. This makes the present invention applicable also to hydraulic drive systems not equipped with the engine revolution speed detecting valve 13.

Other Embodiments

In the above embodiments, the differential pressure between the delivery pressure of the main pump 2 and the maximum load pressure is outputted as the absolute pressure by the output pressure of the differential pressure reducing valve 11 and is lead to the pressure receiving parts 21*b*, 21*c* . . . of the pressure compensating valves 7*b*, 7*c* . . . and to the pressure receiving part 17*e* of the LS control valve 17*b*. However, it is also possible to provide each of the valves 7*b*, 7*c*, . . . , 17*b* (the pressure compensating valves 7*b*, 7*c* . . . and the LS control valve 17*b*) with two pressure receiving parts opposing each other (instead of the pressure receiving part 21*b*, 21*c*, . . . , 17*e*) and lead the delivery pressure of the main pump 2 and the maximum load pressure respectively to the pressure receiving parts.

While the pressure compensating valve 7*a* related to the swing motor 3*a* is designed to have a load-dependent characteristic in the above embodiments, the pressure compensating valve 7*a* may also be implemented by an ordinary pressure compensating valve having no load-dependent characteristic in cases where the reduction of the supply flow rate to the swing motor 3*a* upon a temporary rise in the load pressure of the swing motor 3*a* is unnecessary or an equivalent function is implemented by other means.

In the above embodiments, the main pump 2 is equipped with the stopper and the minimum tilting angle of the main pump 2 is restricted so as to set the minimum delivery flow rate of the main pump 2 higher than the maximum flow rate of the swing motor 3*a* which corresponds to the maximum opening area of the flow rate/direction control valve 6*a*. However, the minimum delivery flow rate of the main pump 2 may also be set at a regular value lower than the maximum demanded flow rate of the swing motor 3*a* in cases where the system instability due to the interference between the load sensing control of the hydraulic pump and the control of the pressure compensating valves is eliminated by other means.

Other Embodiments

A variety of modifications can be made to the above embodiments without departing from the spirit and scope of the present invention. For example, while the output pressure of the differential pressure reducing valve 11 (absolute pressure of the differential pressure between the delivery pressure of the main pump 2 and the maximum load pressure) is lead to the pressure compensating valves 7*a*, 7*b*, 7*c* . . . and the LS control valve 17*b* in the above embodiments, it is also possible to lead the delivery pressure of the main pump 2 and the maximum load pressure separately to the pressure compensating valves 7*a*, 7*b*, 7*c* . . . and the LS control valve 17*b*. In this case, by arranging the solenoid selector valve 48 in the line that leads the delivery pressure of the main pump 2 to the LS control valve 17*b*, the enabling/disabling of the load sensing control can be switched (selected) through the switching of the solenoid selector valve 48 similarly to the first embodiment.

While a hydraulic shovel has been taken as an example of the construction machine in the above embodiments, it is also possible to apply the present invention to various other construction machines (hydraulic crane, wheel shovel, etc.) similarly to the above embodiments and achieve equivalent effects as long as the construction machine comprises a diesel engine, an exhaust gas purification device and a hydraulic drive system that executes the load sensing control and the torque control.

DESCRIPTION OF REFERENCE CHARACTERS

1 Engine
2 Hydraulic pump (Main pump)
3*a*, 3*b*, 3*c* . . . Actuator
4 Control valve
5 Supply line
6*a*, 6*b*, 6*c* . . . Flow rate/direction control valve
7*a*, 7*b*, 7*c* . . . Pressure compensating valve
8*a*, 8*b*, 8*c* . . . Line
9*a*, 9*b*, 9*c* . . . Shuttle valve (Maximum load pressure detecting circuit)
11 Differential pressure reducing valve
12*a*, 12*b* Line
13 Engine revolution speed detecting valve
13*a* Variable throttle valve
13*b* Differential pressure reducing valve
14 Main relief valve
15 Unload valve
15*a* Spring
17 Pump control device
17*a* Torque control tilting piston (Torque control unit)
17*b* LS control valve (Load sensing control unit)
17*c* LS control tilting piston (Load sensing control unit)
17*d*, 17*e* Pressure receiving part
21*a*, 21*b*, 21*c* . . . Pressure receiving part
22*a*, 23*a*, 22*b*, 23*b*, 22*c*, 23*c* . . . Pressure receiving part
24 Gate lock lever
26*a*, 26*b*, 26*c* . . . Load port (Maximum load pressure detecting circuit)
30 Pilot pump
31 Pilot pressure supply line
31*a* to 31*c* Pilot line
32 Pilot relief valve
33, 34 Line
40 Line
41 Exhaust line
42 Exhaust gas purification device
43 Exhaust resistance sensor
44 Forcible regeneration switch
45 Shuttle valve
46 Solenoid selector valve (first selector valve)
48 Solenoid selector valve (second selector valve)
49 Controller (control device)
51 Solenoid selector valve (second selector valve)
52 Pressure booster
100 Gate lock valve
101 Lower track structure
102 Upper swing structure
103 Swing post
104 Front work implement
105 Track frame
106 Blade
107 Swing stage
108 Cab
111 Boom
112 Arm
113 Bucket
122, 123 Control lever unit

The invention claimed is:

1. A hydraulic drive system for a construction machine, comprising:

an engine;

a hydraulic pump of a variable displacement type, the pump being driven by the engine;

a plurality of actuators that are driven by hydraulic fluid delivered from the hydraulic pump;

a plurality of flow rate/direction control valves that control flow rates of the hydraulic fluid supplied from the hydraulic pump to the actuators;

a maximum load pressure detecting circuit that detects maximum load pressure of the actuators;

a pump control device including a torque control unit that conducts constant absorption torque control for controlling absorption torque of the hydraulic pump not to exceed preset maximum torque by reducing displacement of the hydraulic pump with the increase in delivery pressure of the hydraulic pump, and a load sensing control unit that controls the delivery pressure of the hydraulic pump to be higher than the maximum load pressure of the actuators by target differential pressure; and an unload valve that is arranged in a line connecting the hydraulic pump to the plurality of flow rate/direction control valves and restricts the increase in the delivery pressure of the hydraulic pump by shifting to an open state and returning the delivered hydraulic fluid from the hydraulic pump to a tank when the delivery pressure of the hydraulic pump exceeds the sum total of the maximum load pressure and preset pressure, wherein the hydraulic drive system comprises:

a first selector valve that selects between predetermined pressure and tank pressure, outputs the selected pressure, and supplies the output pressure to the maximum load pressure detecting circuit as dummy load pressure;

a second selector valve that selects between enabling and disabling of load sensing control implemented by the load sensing control unit of the pump control device;

an exhaust gas purification device that purifies exhaust gas from the engine; and a control device that actuates the first and second selector valves so that the first selector valve outputs the tank pressure as the dummy load pressure and the second selector valve enables the load sensing control implemented by the pump control device when the exhaust gas purification device does not need regeneration and so that the first selector valve outputs the predetermined pressure as the dummy load pressure and the second selector valve disables the load sensing control implemented by the pump control device when the exhaust gas purification device needs the regeneration.

2. The hydraulic drive system for a construction machine according to claim 1, further comprising:

a pilot pump that is driven by the engine;

a pilot pressure supply line that is connected with the pilot pump and supplies hydraulic fluid for controlling the flow rate/direction control valves; and an engine revolution speed detecting valve that includes a throttling portion arranged in the pilot pressure supply line and generates a hydraulic signal dependent on the engine revolution speed by using pressure loss at the throttling portion, wherein:

the load sensing control unit of the pump control device is configured to set the hydraulic signal generated by the engine revolution speed detecting valve as the target differential pressure of the load sensing control, and the first selector valve outputs delivery pressure of the pilot pump as pressure upstream of the engine revolution speed detecting valve as the predetermined pressure.

3. The hydraulic drive system for a construction machine according to claim 1, further comprising a differential pressure reducing valve that outputs differential pressure between the delivery pressure of the hydraulic pump and the maximum load pressure to the pump control device as absolute pressure, wherein:

the second selector valve is arranged in a line leading the output pressure of the differential pressure reducing valve to the load sensing control unit of the pump control device, and the second selector valve is switched so as to output the output pressure of the differential pressure reducing valve when the exhaust gas purification device does not need the regeneration and to output the tank pressure when the exhaust gas purification device needs the regeneration.

4. The hydraulic drive system for a construction machine according to claim 1, further comprising a pressure detecting device for detecting exhaust resistance of the exhaust gas purification device, wherein the control device executes control to simultaneously switch the first and second selector valves based on the result of the detection by the pressure detecting device.

5. The hydraulic drive system for a construction machine according to claim 1, wherein:

the torque control unit of the pump control device is preset to exhibit a characteristic regarding relationship between the delivery pressure and the displacement of the hydraulic pump, the characteristic being made up of a constant maximum displacement characteristic and a constant maximum absorption torque characteristic, and the torque control unit is configured to control the displacement of the hydraulic pump so as to keep maximum displacement of the hydraulic pump at a constant level even with the increase in the delivery pressure of the hydraulic pump when the delivery pressure of the hydraulic pump is not higher than a first value as pressure at a transition point from the constant maximum displacement characteristic to the constant maximum absorption torque characteristic, and so as to decrease the maximum displacement of the hydraulic pump according to the constant maximum absorption torque characteristic when the delivery pressure of the hydraulic pump increases across the first value, and the predetermined pressure is preset so that the sum total of the predetermined pressure, the preset pressure of the unload valve and override characteristic pressure of the unload valve is not less than pressure around the transition point from the constant maximum displacement characteristic to the constant maximum absorption torque characteristic.

6. The hydraulic drive system for a construction machine according to claim 2, further comprising a differential pressure reducing valve that outputs differential pressure between the delivery pressure of the hydraulic pump and the maximum load pressure to the pump control device as absolute pressure, wherein:

the second selector valve is arranged in a line leading the output pressure of the differential pressure reducing valve to the load sensing control unit of the pump control device, and the second selector valve is switched so as to output the output pressure of the differential pressure reducing valve when the exhaust gas purification device does not need the regeneration and to output the tank pressure when the exhaust gas purification device needs the regeneration.

7. The hydraulic drive system for a construction machine according to claim 2, further comprising a pressure detecting device for detecting exhaust resistance of the exhaust gas purification device, wherein the control device executes control to simultaneously switch the first and second selector valves based on the result of the detection by the pressure detecting device.

8. The hydraulic drive system for a construction machine according to claim 3, further comprising a pressure detecting device for detecting exhaust resistance of the exhaust gas purification device, wherein the control device executes control to simultaneously switch the first and second selector valves based on the result of the detection by the pressure detecting device.

9. The hydraulic drive system for a construction machine according to claim 2, wherein:

the torque control unit of the pump control device is preset to exhibit a characteristic regarding relationship between the delivery pressure and the displacement of the hydraulic pump, the characteristic being made up of a constant maximum displacement characteristic and a constant maximum absorption torque characteristic, and the torque control unit is configured to control the displacement of the hydraulic pump so as to keep maximum displacement of the hydraulic pump at a constant level even with the increase in the delivery pressure of the hydraulic pump when the delivery pressure of the hydraulic pump is not higher than a first value as pressure at a transition point from the constant maximum displacement characteristic to the constant maximum absorption torque characteristic, and so as to decrease the maximum displacement of the hydraulic pump according to the constant maximum absorption torque characteristic when the delivery pressure of the hydraulic pump (2) increases across the first value, and the predetermined pressure is preset so that the sum total of the predetermined pressure, the preset pressure of the unload valve and override characteristic pressure of the unload valve is not less than pressure around the transition point from the constant maximum displacement characteristic to the constant maximum absorption torque characteristic.

10. The hydraulic drive system for a construction machine according to claim 3, wherein:

the torque control unit of the pump control device is preset to exhibit a characteristic regarding relationship between the delivery pressure and the displacement of the hydraulic pump, the characteristic being made up of a constant maximum displacement characteristic and a constant maximum absorption torque characteristic, and the torque control unit is configured to control the displacement of the hydraulic pump so as to keep maximum displacement of the hydraulic pump at a constant level even with the increase in the delivery pressure of the hydraulic pump when the delivery pressure of the hydraulic pump is not higher than a first value as pressure at a transition point from the constant maximum displacement characteristic to the constant maximum absorption torque characteristic, and so as to decrease the maximum displacement of the hydraulic pump according to the constant maximum absorption torque characteristic when the delivery pressure of the hydraulic pump increases across the first value, and the predetermined pressure is preset so that the sum total of the predetermined pressure, the preset pressure of the unload valve and override characteristic pressure of the unload valve is not less than pressure around the transition point from the constant maximum displacement characteristic to the constant maximum absorption torque characteristic.

11. The hydraulic drive system for a construction machine according to claim 4, wherein:

the torque control unit of the pump control device is preset to exhibit a characteristic regarding relationship between the delivery pressure and the displacement of the hydraulic pump, the characteristic being made up of a constant maximum displacement characteristic and a constant maximum absorption torque characteristic, and the torque control unit is configured to control the displacement of the hydraulic pump so as to keep maximum displacement of the hydraulic pump at a constant level even with the increase in the delivery pressure of the hydraulic pump when the delivery pressure of the hydraulic pump is not higher than a first value as pressure at a transition point from the constant maximum displacement characteristic to the constant maximum absorption torque characteristic, and so as to decrease the maximum displacement of the hydraulic pump according to the constant maximum absorption torque characteristic when the delivery pressure of the hydraulic pump increases across the first value, and the predetermined pressure is preset so that the sum total of the predetermined pressure, the preset pressure of the unload valve and override characteristic pressure of the unload valve is not less than pressure around the transition point from the constant maximum displacement characteristic to the constant maximum absorption torque characteristic.

* * * * *